US009246221B2

(12) United States Patent
Jin et al.

(10) Patent No.: US 9,246,221 B2
(45) Date of Patent: Jan. 26, 2016

(54) TUNABLE LOOP ANTENNAS

(75) Inventors: Nanbo Jin, Sunnyvale, CA (US); Mattia Pascolini, Campbell, CA (US); Matt A. Mow, Los Altos, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 927 days.

(21) Appl. No.: 13/041,934

(22) Filed: Mar. 7, 2011

(65) Prior Publication Data

US 2012/0231750 A1 Sep. 13, 2012

(51) Int. Cl.
*H01Q 1/24* (2006.01)
*H01Q 7/00* (2006.01)

(52) U.S. Cl.
CPC ..... *H01Q 7/005* (2013.01); *H01Q 1/243* (2013.01)

(58) Field of Classification Search
CPC ..... H01Q 1/24; H01Q 1/241; H01Q 1/242; H01Q 1/243; H01Q 1/38; H01Q 5/00; H01Q 7/00; H01Q 7/005
USPC ..... 343/702, 741–745, 748, 860, 861
See application file for complete search history.

(56) References Cited

U.S. PATENT DOCUMENTS 2,324,462 A 7/1943 Leeds et al.
2,942,263 A 6/1960 Baldwin
3,394,373 A 7/1968 Makrancy
3,736,591 A * 5/1973 Rennels et al. ..... 343/702
4,123,756 A * 10/1978 Nagata et al. ..... 343/702
4,349,840 A 9/1982 Henderson
4,380,011 A 4/1983 Torres et al.
4,518,965 A 5/1985 Hidaka
4,617,571 A 10/1986 Choquer et al.
4,625,212 A 11/1986 Oda et al.

(Continued)

FOREIGN PATENT DOCUMENTS

CN 1745500 3/2006
CN 1764077 4/2006

(Continued)

OTHER PUBLICATIONS

Jarvis et al., U.S. Appl. No. 12/823,929, filed Jun. 25, 2010.

(Continued)

*Primary Examiner* — Michael C Wimer
(74) *Attorney, Agent, or Firm* — Treyz Law Group; G. Victor Treyz; Joseph F. Guihan

(57) ABSTRACT

Electronic devices are provided that contain wireless communications circuitry. The wireless communications circuitry may include radio-frequency transceiver circuitry and antenna structures. A parallel-fed loop antenna may be formed from portions of a conductive bezel and a ground plane. The antenna may operate in multiple communications bands. The bezel may surround a peripheral portion of a display that is mounted to the front of an electronic device. The bezel may contain a gap. Antenna feed terminals for the antenna may be located on opposing sides of the gap. A variable capacitor may bridge the gap. An inductive element may bridge the gap and the antenna feed terminals. A switchable inductor may be coupled in parallel with the inductive element. Tunable matching circuitry may be coupled between one of the antenna feed terminals and a conductor in a coaxial cable connecting the transceiver circuitry to the antenna.

24 Claims, 17 Drawing Sheets

(56) References Cited

U.S. PATENT DOCUMENTS 4,879,755 A 11/1989 Stolarczyk et al.
4,893,131 A * 1/1990 Smith et al. ..... 343/713
4,894,663 A 1/1990 Urbish
4,980,694 A 12/1990 Hines
5,021,010 A 6/1991 Wright
5,023,621 A 6/1991 Ushiyama et al.
5,041,838 A 8/1991 Liimatainen
5,048,118 A 9/1991 Brooks
5,061,943 A 10/1991 Rammos
5,105,396 A 4/1992 Ganter et al.
5,159,707 A 10/1992 Mogi et al.
5,381,387 A 1/1995 Blonder et al.
5,408,241 A 4/1995 Shattuck
5,465,098 A 11/1995 Fujisawa et al.
5,473,252 A 12/1995 Renz et al.
5,561,437 A 10/1996 Phillips
5,585,810 A 12/1996 Tsru et al.
5,627,552 A 5/1997 Farrar et al.
5,754,143 A 5/1998 Warnagiris
5,768,691 A 6/1998 Matero et al.
5,798,984 A 8/1998 Koch
5,812,066 A 9/1998 Terk et al.
6,011,699 A 1/2000 Murray
6,014,113 A 1/2000 Orchard et al.
6,021,317 A 2/2000 Irvin
6,097,345 A 8/2000 Walton
6,171,138 B1 1/2001 Lefebvre et al.
6,269,054 B1 7/2001 Truini
6,282,433 B1 8/2001 Holshouser
6,337,662 B1 1/2002 Cassel
6,339,400 B1 1/2002 Flint et al.
6,518,929 B1 2/2003 Gilmore
6,560,443 B1 5/2003 Vaisaneri et al.
6,606,063 B1 8/2003 Merenda
6,622,031 B1 9/2003 McCleary
6,670,923 B1 12/2003 Kadambi et al.
6,741,214 B1 5/2004 Kadambi et al.
6,747,601 B2 6/2004 Boyle
6,762,723 B2 7/2004 Nallo
6,812,898 B2 11/2004 Doub et al.
6,853,605 B2 2/2005 Fujisawa et al.
6,856,294 B2 2/2005 Kadambi et al.
6,885,880 B1 4/2005 All
6,894,647 B2 5/2005 Jenwatenavel
6,933,897 B2 8/2005 Takeshi et al.
6,968,508 B2 11/2005 Lucaci
6,980,154 B2 12/2005 Vance et al.
7,027,838 B2 4/2006 Zhou et al.
7,035,170 B2 4/2006 Narayanaswami et al.
7,084,814 B2 8/2006 Chen et al.
7,116,267 B2 10/2006 Schuster et al.
7,116,276 B2 10/2006 Lee
7,119,747 B2 10/2006 Lin et al.
7,123,208 B2 10/2006 Baliarda et al.
7,132,987 B1 11/2006 Olsson et al.
7,155,178 B2 12/2006 Chang et al.
7,164,387 B2 1/2007 Sievenpiper
7,167,090 B1 1/2007 Mandal et al.
7,176,842 B2 2/2007 Bettren et al.
7,212,161 B2 5/2007 Chen Zhi et al
7,215,283 B2 5/2007 Boyle
7,215,600 B1 5/2007 DeRosa
7,239,889 B2 7/2007 Saari et al.
7,250,910 B2 7/2007 Yoshikawa et al.
7,260,424 B2 8/2007 Schmidt
7,271,769 B2 9/2007 Asano et al.
7,340,286 B2 3/2008 Korva et al.
7,348,928 B2 3/2008 Ma et al.
7,372,406 B2 5/2008 Shiotsu et al.
7,408,517 B1 8/2008 Poilasne et al.
7,420,511 B2 9/2008 Oshiyama et al.
7,551,142 B1 6/2009 Zhang et al.
7,595,759 B2 9/2009 Schlub et al.
7,612,725 B2 11/2009 Hill et al.
7,619,574 B1 11/2009 West
7,623,079 B2 11/2009 Hayashi
7,652,629 B2 1/2010 Teshima
7,671,693 B2 3/2010 Brobston et al.
7,671,804 B2 3/2010 Zhang et al.
7,696,932 B2 4/2010 Desclos et al.
7,714,790 B1 5/2010 Feldstein et al.
7,768,461 B2 8/2010 Cheng et al.
7,768,462 B2 8/2010 Zhang et al.
7,768,468 B2 8/2010 Gustafson et al.
7,869,830 B2 1/2011 Hartenstein et al.
7,876,274 B2 1/2011 Hobson et al.
7,884,769 B2 2/2011 Boyle
7,889,139 B2 2/2011 Hobson et al.
7,936,307 B2 5/2011 Pang et al.
8,009,110 B2 8/2011 Teng et al.
8,040,656 B2 10/2011 Park et al.
8,054,240 B2 11/2011 Hondo
8,102,319 B2 1/2012 Schlub et al.
8,102,321 B2 1/2012 Chiang et al.
8,106,836 B2 1/2012 Hill et al.
8,169,373 B2 5/2012 Schlub et al.
8,204,446 B2 6/2012 Scheer et al.
8,227,700 B2 7/2012 Kim
8,233,950 B2 7/2012 Hobson
8,421,702 B2 4/2013 Desclos et al.
8,665,164 B2 3/2014 Hill et al.
2001/0043514 A1 11/2001 Kita
2002/0126236 A1 9/2002 Hiratsuka
2003/0107518 A1 6/2003 Li et al.
2003/0117900 A1 6/2003 Fujisawa et al.
2004/0008146 A1 1/2004 Ikegaya et al.
2004/0017318 A1 1/2004 Annabi
2004/0041734 A1 3/2004 Shiotsu et al.
2004/0056806 A1 3/2004 Ma
2004/0090377 A1 5/2004 Dai et al.
2004/0116157 A1 6/2004 Vance et al.
2004/0145521 A1 7/2004 Hebron et al.
2004/0207559 A1 10/2004 Milosavljevic
2004/0222926 A1 11/2004 Kontogerogakis et al.
2004/0227678 A1 11/2004 Sievenpiper
2004/0257283 A1 12/2004 Asano et al.
2004/0263411 A1 12/2004 Fabrega-Sanchez et al.
2005/0073462 A1 4/2005 Lin et al.
2005/0085204 A1 4/2005 Poilasne et al.
2006/0055606 A1 3/2006 Boyle
2006/0097941 A1 5/2006 Bettren et al.
2006/0114159 A1 6/2006 Yoshikawa et al.
2006/0125703 A1 6/2006 Ma et al.
2006/0139211 A1 6/2006 Vance et al.
2007/0146218 A1 6/2007 Turner et al.
2007/0149145 A1 6/2007 Chang et al.
2007/0176843 A1 8/2007 Qureshi
2007/0182658 A1 8/2007 Ozden
2007/0200766 A1 8/2007 McKinzie et al.
2007/0216590 A1 9/2007 Montgomery et al.
2007/0218853 A1 9/2007 Yu
2007/0222697 A1 9/2007 Caimi et al.
2007/0224948 A1 9/2007 Hartenstein et al.
2007/0229376 A1 10/2007 Descoles et al.
2007/0268191 A1 11/2007 Ishizuka et al.
2008/0081581 A1 4/2008 Rofougaran
2008/0100514 A1 5/2008 Abdul-Gaffoor et al.
2008/0143613 A1 6/2008 Iwai et al.
2008/0150811 A1 6/2008 Honda et al.
2008/0218291 A1 9/2008 Zhu et al.
2008/0266199 A1 10/2008 Milosavljevic et al.
2008/0316115 A1 12/2008 Hill et al.
2009/0051604 A1 2/2009 Zhang et al.
2009/0081963 A1 3/2009 Boren
2009/0128428 A1 5/2009 Ishizuka et al.
2009/0153407 A1 6/2009 Zhang et al.
2009/0153412 A1 6/2009 Chiang et al.
2009/0179811 A1 7/2009 Chou
2009/0180403 A1 7/2009 Tudosoiu
2009/0185325 A1 7/2009 Park et al.
2009/0256758 A1 10/2009 Schlub et al.
2009/0256759 A1 10/2009 Hill et al.
2010/0007564 A1 1/2010 Hill et al.
2010/0022203 A1 1/2010 Bonnet et al.

(56) References Cited

U.S. PATENT DOCUMENTS

| | | | |
|---|---|---|---|
| 2010/0053002 | A1 | 3/2010 | Wojack et al. |
| 2010/0060421 | A1 | 3/2010 | Chang et al. |
| 2010/0060529 | A1 | 3/2010 | Schlub et al. |
| 2010/0109968 | A1 | 5/2010 | Suzuki et al. |
| 2010/0123632 | A1 | 5/2010 | Hill et al. |
| 2010/0149052 | A1 | 6/2010 | Nishio et al. |
| 2010/0214180 | A1 | 8/2010 | Krogerus |
| 2010/0231481 | A1 | 9/2010 | Chiang et al. |
| 2010/0245201 | A1 | 9/2010 | Hossain et al. |
| 2010/0271271 | A1 | 10/2010 | Wu |
| 2011/0006953 | A1 | 1/2011 | Chiang et al. |
| 2011/0063779 | A1 | 3/2011 | Ochi et al. |
| 2011/0136447 | A1 | 6/2011 | Pascolini et al. |
| 2011/0183633 | A1 | 7/2011 | Ohba et al. |
| 2011/0291896 | A1 | 12/2011 | Pascolini et al. |
| 2012/0098720 | A1 | 4/2012 | Hill et al. |
| 2012/0112970 | A1 | 5/2012 | Caballero et al. |
| 2012/0115553 | A1 | 5/2012 | Mahe et al. |
| 2012/0162033 | A1 | 6/2012 | Togashi |
| 2012/0231750 | A1 | 9/2012 | Jin et al. |
| 2012/0245201 | A1 | 9/2012 | Markowitz et al. |
| 2013/0009828 | A1 | 1/2013 | Pascolini et al. |
| 2013/0169490 | A1 | 7/2013 | Pascolini et al. |
| 2013/0229322 | A1 | 9/2013 | Wang |

FOREIGN PATENT DOCUMENTS

| | | | |
|---|---|---|---|
| CN | 101002361 | | 7/2007 |
| CN | 101002362 | | 7/2007 |
| CN | 101483270 | | 7/2009 |
| CN | 101496224 | | 7/2009 |
| CN | 101540620 | | 9/2009 |
| CN | 101682119 | | 3/2010 |
| CN | 201533015 | | 7/2010 |
| CN | 101814649 | | 8/2010 |
| CN | 101911379 | | 12/2010 |
| CN | 202025842 | | 11/2011 |
| CN | 102683861 | | 9/2012 |
| DE | 20314836 | | 11/2003 |
| DE | 10353104 | | 6/2005 |
| EP | 0741433 | | 11/1996 |
| EP | 1093098 | | 4/2001 |
| EP | 1280230 | | 1/2003 |
| EP | 1286413 | | 2/2003 |
| EP | 1315238 | | 5/2003 |
| EP | 1401050 | | 3/2004 |
| EP | 1753082 | | 4/2005 |
| EP | 1553658 | | 7/2005 |
| EP | 1557903 | | 7/2005 |
| EP | 1594188 | | 11/2005 |
| EP | 1686651 | A2 | 8/2006 |
| EP | 1995889 | | 11/2008 |
| EP | 2048739 | | 4/2009 |
| EP | 2161785 | | 3/2010 |
| EP | 2219265 | | 8/2010 |
| EP | 2219615 | | 8/2010 |
| EP | 2405534 | | 1/2012 |
| GB | 921950 | | 3/1963 |
| GB | 944039 | | 12/1963 |
| GB | 0944039 | | 12/1963 |
| GB | 2384367 | | 7/2003 |
| JP | 3-502269 | | 5/1991 |
| JP | 09-093029 | | 4/1997 |
| JP | 09-307344 | | 11/1997 |
| JP | 2001136019 | | 5/2001 |
| JP | 2001185927 | | 7/2001 |
| JP | 2004-48119 | | 2/2004 |
| JP | 2006180077 | | 7/2006 |
| JP | 2009049455 | | 3/2009 |
| JP | 2010147636 | | 7/2010 |
| JP | 2010536246 | | 11/2010 |
| JP | 4775771 | | 9/2011 |
| KR | 1986000331 | | 4/1986 |
| KR | 2004108759 | | 12/2004 |
| KR | 10-2005-0098880 | | 10/2005 |
| TW | 310084 | | 7/1997 |
| TW | 200929687 | | 7/2009 |
| TW | M367429 | | 10/2009 |
| WO | 8905530 | | 6/1989 |
| WO | 0159945 | | 8/2001 |
| WO | 02078123 | | 10/2002 |
| WO | 03096474 | | 11/2003 |
| WO | 04001894 | | 12/2003 |
| WO | 2004102744 | | 11/2004 |
| WO | 2005032130 | | 4/2005 |
| WO | 2005109567 | | 11/2005 |
| WO | 2006114771 | | 11/2006 |
| WO | 2007012697 | | 2/2007 |
| WO | 2007039667 | | 4/2007 |
| WO | 2007039668 | | 4/2007 |
| WO | 2008010149 | | 1/2008 |
| WO | 2008013021 | | 1/2008 |
| WO | 2008055039 | | 5/2008 |
| WO | 2009002575 | | 12/2008 |
| WO | 2009091323 | | 7/2009 |
| WO | 2009145264 | | 12/2009 |
| WO | 2010025023 | | 3/2010 |
| WO | 2012006152 | | 1/2012 |

OTHER PUBLICATIONS

Schlub et al., U.S. Appl. No. 12/759,243, filed Apr. 13, 2010.
Nickel et al., U.S. Appl. No. 12/752,966, filed Apr. 1, 2010.
U.S. Appl. No. 60/833,587, filed Jan. 5, 2007, Hobson et al.
Pascolini et al., U.S. Appl. No. 12/630,756, filed Dec. 3, 2009.
Mow et al., U.S. Appl. No. 12/831,180, filed Jul. 6, 2010.
Caballero, et al., U.S. Appl. No. 12/941,010, filed Nov. 5, 2010.
Lee et al. "A Compact and Low-Profile Tunable Loop Antenna Integrated With Inductors", IEEE Antennas and Wireless Propagation Letters, vol. 7, 2008 pp. 621-624.
Nanbo Jin et al., U.S. Appl. No. 13/041,905, filed Mar. 7, 2011.
Menzel et al., "A Microstrip Patch Antenna with Coplanar Feed Line" IEEE Microwave and Guided Wave Letters, vol. 1, No. 11, Nov. 1991, pp. 340-342.
Terada et al., "Circularly Polarized Tunable Microstrip Patch Antenna Using an Adjustable Air Gap", Proceedings of ISAP2005, Seoul, Korea pp. 977-980, Aug. 3-Aug. 5, 2005.

* cited by examiner

TUNABLE LOOP ANTENNAS

BACKGROUND

This relates generally to wireless communications circuitry, and more particularly, to electronic devices that have wireless communications circuitry.

Electronic devices such as handheld electronic devices are becoming increasingly popular. Examples of handheld devices include handheld computers, cellular telephones, media players, and hybrid devices that include the functionality of multiple devices of this type.

Devices such as these are often provided with wireless communications capabilities. For example, electronic devices may use long-range wireless communications circuitry such as cellular telephone circuitry to communicate using cellular telephone bands at 850 MHz, 900 MHz, 1800 MHz, and 1900 MHz (e.g., the main Global System for Mobile Communications or GSM cellular telephone bands). Long-range wireless communications circuitry may also handle the 2100 MHz band. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz.

To satisfy consumer demand for small form factor wireless devices, manufacturers are continually striving to implement wireless communications circuitry such as antenna components using compact structures. However, it can be difficult to fit conventional antenna structures into small devices. For example, antennas that are confined to small volumes often exhibit narrower operating bandwidths than antennas that are implemented in larger volumes. If the bandwidth of an antenna becomes too small, the antenna will not be able to cover all communications bands of interest.

In view of these considerations, it would be desirable to provide improved wireless circuitry for electronic devices.

SUMMARY

Electronic devices may be provided that include antenna structures. An antenna may be configured to operate in first and second communications bands. An electronic device may contain radio-frequency transceiver circuitry that is coupled to the antenna using a transmission line. The transmission line may have a positive conductor and a ground conductor. The antenna may have a positive antenna feed terminal and a ground antenna feed terminal to which the positive and ground conductors of the transmission line are respectively coupled.

The electronic device may have a rectangular periphery. A rectangular display may be mounted on a front face of the electronic device. The electronic device may have a rear face that is formed form a plastic housing member. Conductive sidewall structures may run around the periphery of the electronic device housing and display. The conductive sidewall structures may serve as a bezel for the display.

The bezel may include at least one gap. The gap may be filled with a solid dielectric such as plastic. The antenna may be formed from the portion of the bezel that includes the gap and a portion of a ground plane. To avoid excessive sensitivity to touch events, the antenna may be fed using a feed arrangement that reduces electric field concentration in the vicinity of the gap.

An inductive element may be formed in parallel with the antenna feed terminals, whereas a capacitive element may be formed in series with one of the antenna feed terminals. The inductive element may be formed from a transmission line inductive structure that bridges the antenna feed terminals. The capacitive element may be formed from a capacitor that is interposed in the positive feed path for the antenna. The capacitor may, for example, be connected between the positive ground conductor of the transmission line and the positive antenna feed terminal.

A switchable inductor circuit may be coupled in parallel with the inductive element. A tunable matching circuit may also be interposed in the positive feed path for the antenna (e.g., the tunable matching circuit may be connected in series with the capacitive element). A variable capacitor circuit may bridge the gap. The switching inductor circuit, the tunable matching circuit, and the variable capacitor serve as antenna tuning circuitry that can be used to allow the antenna to resonate at different frequency bands.

A wireless device formed using this arrangement may be operable in first and second modes. In the first mode, the switchable inductor circuit may be turned to enable the antenna of the wireless device to operable in a first low-band region and a high-band region. In the second mode, the switchable inductor circuit may be turned off to enable the antenna of the wireless device to operate in a second low-band region and the high-band region. The first and second low-band regions may or may not overlap in frequency.

The tunable matching circuit may be configured to provide desired sub-band coverage within a selected band region. The variable capacitor circuit may be adjusted to fine tune the frequency characteristic of the loop antenna.

Further features of the invention, its nature and various advantages will be more apparent from the accompanying drawings and the following detailed description of the preferred embodiments.

DETAILED DESCRIPTION

Electronic devices may be provided with wireless communications circuitry. The wireless communications circuitry may be used to support wireless communications in multiple wireless communications bands. The wireless communications circuitry may include one or more antennas.

The antennas can include loop antennas. Conductive structures for a loop antenna may, if desired, be formed from conductive electronic device structures. The conductive electronic device structures may include conductive housing structures. The housing structures may include a conductive bezel. Gap structures may be formed in the conductive bezel. The antenna may be parallel-fed using a configuration that helps to minimize sensitivity of the antenna to contact with a user's hand or other external object.

Any suitable electronic devices may be provided with wireless circuitry that includes loop antenna structures. As an example, loop antenna structures may be used in electronic devices such as desktop computers, game consoles, routers, laptop computers, etc. With one suitable configuration, loop antenna structures are provided in relatively compact electronic devices in which interior space is relatively valuable such as portable electronic devices.

Figure 1:
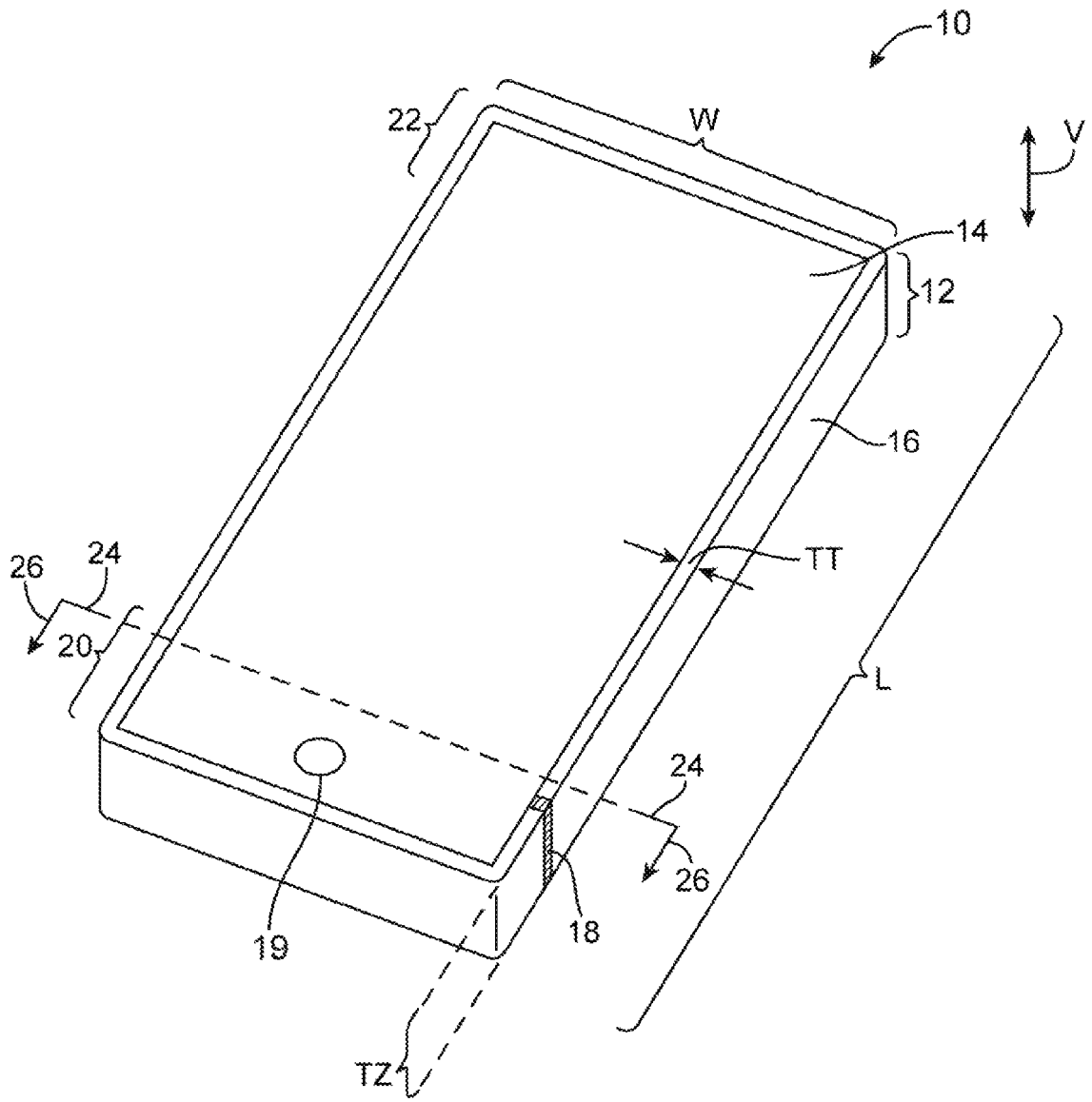
FIG. 1 is a perspective view of an illustrative electronic device with wireless communications circuitry in accordance with an embodiment of the present invention.

An illustrative portable electronic device in accordance with an embodiment of the present invention is shown in FIG. 1. Portable electronic devices such as illustrative portable electronic device 10 may be laptop computers or small portable computers such as ultraportable computers, netbook computers, and tablet computers. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices are handheld electronic devices such as cellular telephones.

Space is at a premium in portable electronic devices. Conductive structures are also typically present, which can make efficient antenna operation challenging. For example, conductive housing structures may be present around some or all of the periphery of a portable electronic device housing.

In portable electronic device housing arrangements such as these, it may be particularly advantageous to use loop-type antenna designs that cover communications bands of interest. The use of portable devices such as handheld devices is therefore sometimes described herein as an example, although any suitable electronic device may be provided with loop antenna structures, if desired.

Handheld devices may be, for example, cellular telephones, media players with wireless communications capabilities, handheld computers (also sometimes called personal digital assistants), remote controllers, global positioning system (GPS) devices, and handheld gaming devices. Handheld devices and other portable devices may, if desired, include the functionality of multiple conventional devices. Examples of multi-functional devices include cellular telephones that include media player functionality, gaming devices that include wireless communications capabilities, cellular telephones that include game and email functions, and handheld devices that receive email, support mobile telephone calls, and support web browsing. These are merely illustrative examples. Device 10 of FIG. 1 may be any suitable portable or handheld electronic device.

Device 10 includes housing 12 and includes at least one antenna for handling wireless communications. Housing 12, which is sometimes referred to as a case, may be formed of any suitable materials including, plastic, glass, ceramics, composites, metal, or other suitable materials, or a combination of these materials. In some situations, parts of housing 12 may be formed from dielectric or other low-conductivity material, so that the operation of conductive antenna elements that are located within housing 12 is not disrupted. In other situations, housing 12 may be formed from metal elements.

Device 10 may, if desired, have a display such as display 14. Display 14 may, for example, be a touch screen that incorporates capacitive touch electrodes. Display 14 may include image pixels formed form light-emitting diodes (LEDs), organic LEDs (OLEDs), plasma cells, electronic ink elements, liquid crystal display (LCD) components, or other suitable image pixel structures. A cover glass member may cover the surface of display 14. Buttons such as button 19 may pass through openings in the cover glass.

Housing 12 may include sidewall structures such as sidewall structures 16. Structures 16 may be implemented using conductive materials. For example, structures 16 may be implemented using a conductive ring member that substantially surrounds the rectangular periphery of display 14. Structures 16 may be formed from a metal such as stainless steel, aluminum, or other suitable materials. One, two, or more than two separate structures may be used in forming structures 16. Structures 16 may serve as a bezel that holds display 14 to the front (top) face of device 10. Structures 16 are therefore sometimes referred to herein as bezel structures 16 or bezel 16. Bezel 16 runs around the rectangular periphery of device 10 and display 14.

Bezel 16 may have a thickness (dimension TT) of about 0.1 mm to 3 mm (as an example). The sidewall portions of bezel 16 may be substantially vertical (parallel to vertical axis V). Parallel to axis V, bezel 16 may have a dimension TZ of about 1 mm to 2 cm (as an example). The aspect ratio R of bezel 16 (i.e., the of TZ to TT) is typically more than 1 (i.e., R may be greater than or equal to 1, greater than or equal to 2, greater than or equal to 4, greater than or equal to 10, etc.).

It is not necessary for bezel 16 to have a uniform cross-section. For example, the top portion of bezel 16 may, if desired, have an inwardly protruding lip that helps hold display 14 in place. If desired, the bottom portion of bezel 16 may also have an enlarged lip (e.g., in the plane of the rear surface of device 10). In the example of FIG. 1, bezel 16 has substantially straight vertical sidewalls. This is merely illustrative. The sidewalls of bezel 16 may be curved or may have any other suitable shape.

Display 14 includes conductive structures such as an array of capacitive electrodes, conductive lines for addressing pixel elements, driver circuits, etc. These conductive structures tend to block radio-frequency signals. It may therefore be desirable to form some or all of the rear planar surface of device from a dielectric material such as plastic.

Portions of bezel 16 may be provided with gap structures. For example, bezel 16 may be provided with one or more gaps such as gap 18, as shown in FIG. 1. Gap 18 lies along the periphery of the housing of device 10 and display 12 and is therefore sometimes referred to as a peripheral gap. Gap 18 divides bezel 16 (i.e., there is generally no conductive portion of bezel 16 in gap 18).

As shown in FIG. 1, gap 18 may be filled with dielectric. For example, gap 18 may be filled with air. To help provide device 10 with a smooth uninterrupted appearance and to ensure that bezel 16 is aesthetically appealing, gap 18 may be filled with a solid (non-air) dielectric such as plastic. Bezel 16 and gaps such as gap (and its associated plastic filler structure) may form part of one or more antennas in device 10. For example, portions of bezel 16 and gaps such as gap 18 may, in conjunction with internal conductive structures, form one or more loop antennas. The internal conductive structures may include printed circuit board structures, frame members or other support structures, or other suitable conductive structures.

In a typical scenario, device 10 may have upper and lower antennas (as an example). An upper antenna may, for example, be formed at the upper end of device 10 in region 22. A lower antenna may, for example, be formed at the lower end of device 10 in region 20.

The lower antenna may, for example, be formed partly from the portions of bezel 16 in the vicinity of gap 18.

Antennas in device 10 may be used to support any communications bands of interest. For example, device 10 may include antenna structures for supporting local area network communications, voice and data cellular telephone communications, global positioning system (GPS) communications, Bluetooth® communications, etc. As an example, the lower antenna in region 20 of device 10 may be used in handling voice and data communications in one or more cellular telephone bands.

Figure 2:
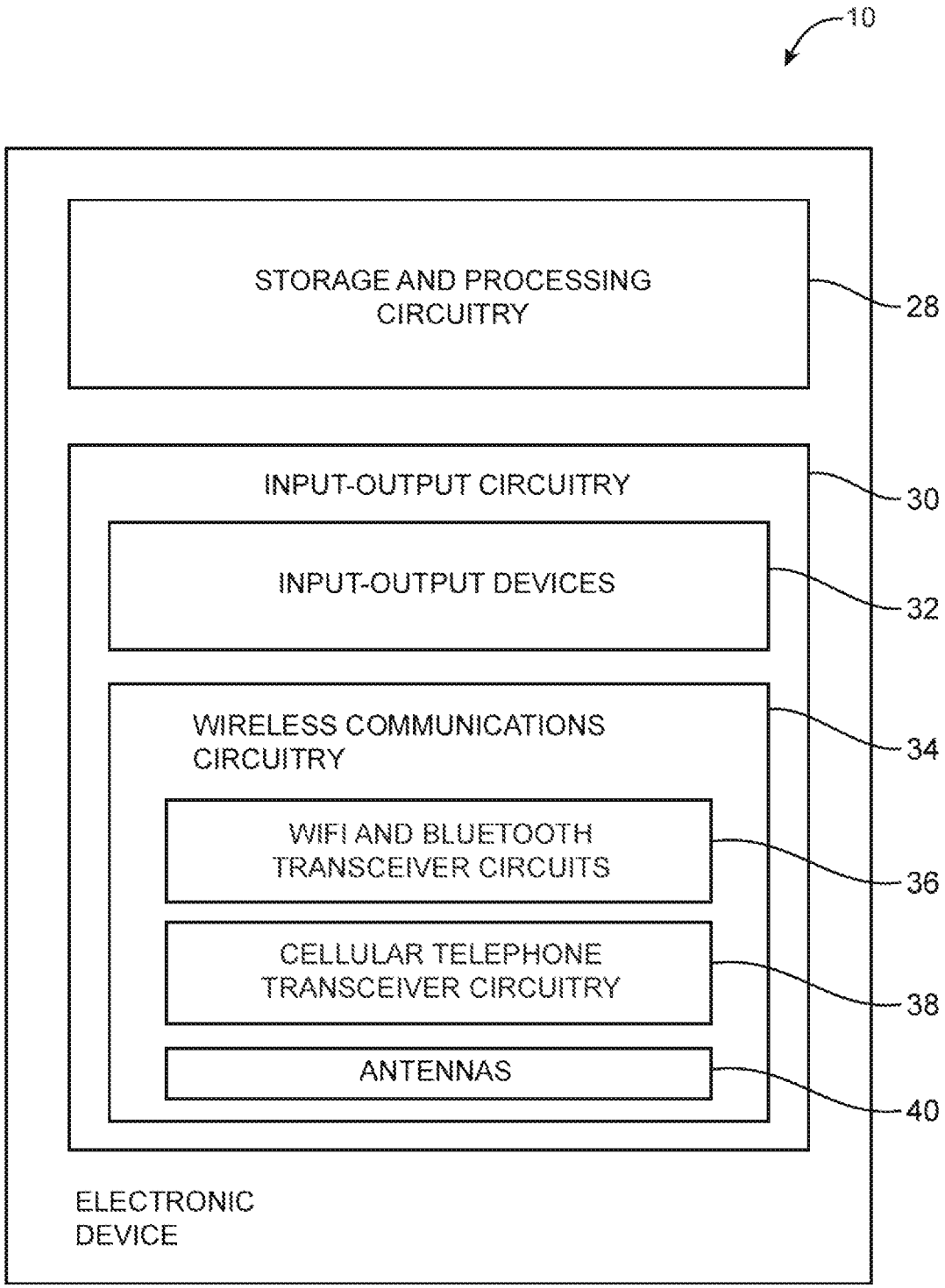
FIG. 2 is a schematic diagram of an illustrative electronic device with wireless communications circuitry in accordance with an embodiment of the present invention.

A schematic diagram of an illustrative electronic device is shown in FIG. 2. Device 10 of FIG. 2 may be a portable computer such as a portable tablet computer, a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, applications specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Input-output circuitry 30 may be used to allow data to be supplied to device 10 and to allow data to be provided from device 10 to external devices. Input-output devices 32 such as touch screens and other user input interface are examples of input-output circuitry 32. Input-output devices 32 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices such as display 14 (FIG. 1) and other components that present visual information and status data may be included in devices 32. Display and audio components in input-output devices 32 may also include audio equipment such as speakers and other devices for creating sound. If desired, input-output devices 32 may contain audio-video interface equipment such as jacks and other connectors for external headphones and monitors.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 34 may include radio-frequency transceiver circuits for handling multiple radio-frequency communications bands. Examples of cellular telephone standards that may be supported by wireless circuitry 34 and device 10 include: the Global System for Mobile Communications (GSM) "2G" cellular telephone standard, the Evolution-Data Optimized (EVDO) cellular telephone standard, the "3G" Universal Mobile Telecommunications System (UMTS) cellular telephone standard, the "3G" Code Division Multiple Access 2000 (CDMA 2000) cellular telephone standard, and the 3GPP Long Term Evolution (LTE) cellular telephone standard. Other cellular telephone standards may be used if desired. These cellular telephone standards are merely illustrative.

Wireless communications circuitry 34 can include circuitry for other short-range and long-range wireless links if desired. For example, wireless communications circuitry 34 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structure, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link.

With one suitable arrangement, which is sometimes described herein as an example, the lower antenna in device (i.e., an antenna 40 located in region 20 of device 10 of FIG. 1) may be formed using a loop-type antenna design. When a user holds device 10, the user's fingers may contact the exterior of device 10. For example, the user may touch device 10 in region 20. To ensure that antenna performance is not overly sensitive to the presence or absence of a user's touch or contact by other external objects, the loop-type antenna may be fed using an arrangement that does not overly concentrate electric fields in the vicinity of gap 18.

Figure 3:
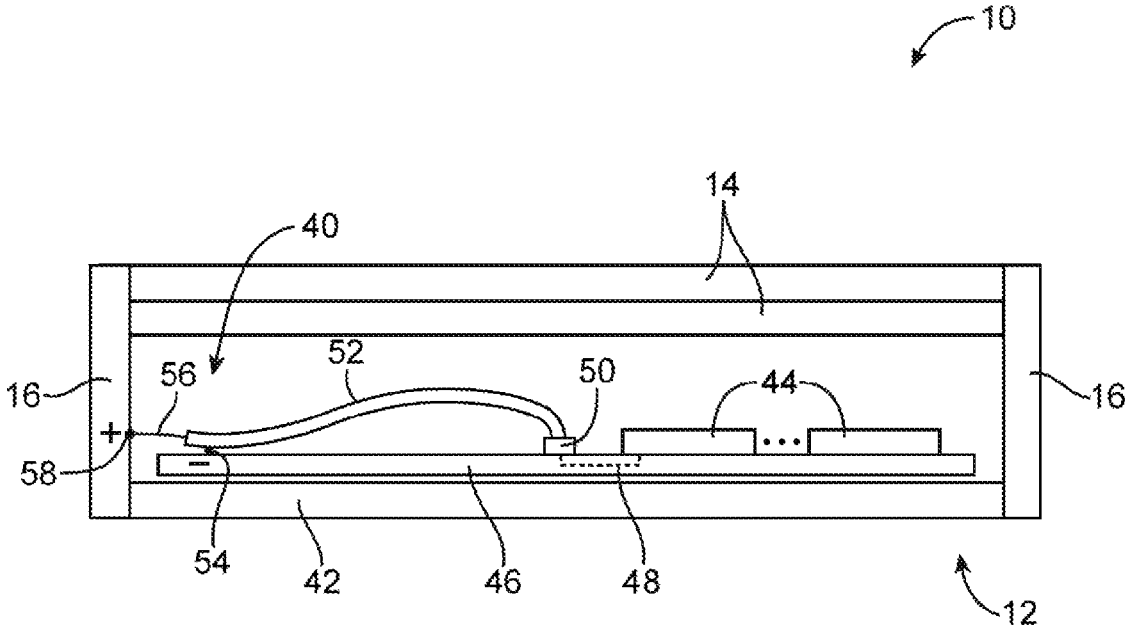
FIG. 3 is a cross-sectional end view of an illustrative electronic device with wireless communications circuitry in accordance with an embodiment of the present invention.

A cross-sectional side view of device 10 of FIG. 1 taken along line 24-24 in FIG. 1 and viewed in direction 26 is shown in FIG. 3. As shown in FIG. 3, display 14 may be mounted to the front surface of device 10 using bezel 16. Housing 12 may include sidewalls formed from bezel 16 and one or more rear walls formed from structures such as planar rear housing structure 42. Structure 42 may be formed from a dielectric such as plastic or other suitable materials. Snaps, clips, screws, adhesive, and other structures may be used in attaching bezel 16 to display 14 and rear housing wall structure 42.

Device 10 may contain printed circuit boards such as printed circuit board 46. Printed circuit board 46 and the other printed circuit boards in device 10 may be formed from rigid printed circuit board material (e.g., fiberglass-filled epoxy) or flexible sheets of material such as polymers. Flexible printed circuit boards ("flex circuits") may, for example, be formed from flexible sheets of polyimide.

Printed circuit board 46 may contain interconnects such as interconnects 48. Interconnects 48 may be formed from conductive traces (e.g., traces of gold-plated copper or other metals). Connectors such as connector 50 may be connected to interconnects 48 using solder or conductive adhesive (as examples). Integrated circuits, discrete components such as resistors, capacitors, and inductors, and other electronic components may be mounted to printed circuit board 46.

Antenna 40 may have antenna feed terminals. For example, antenna 40 may have a positive antenna feed terminal such as positive antenna feed terminal 58 and a ground antenna feed terminal such as ground antenna feed terminal 54. In the illustrative arrangement of FIG. 3, a transmission line path such as coaxial cable 52 may be coupled between the antenna feed formed from terminals 58 and 54 and transceiver circuitry in components 44 via connector 50 and interconnects 48. Components 44 may include one or more integrated circuits that implement the transceiver circuits 36 and 38 of FIG. 2. Connector 50 may be, for example, a coaxial cable connector that is connected to printed circuit board 46. Cable 52 may be a coaxial cable or other transmission line. Terminal 58 may be coupled to coaxial cable center connector 56. Terminal 54 may be connected to a ground conductor in cable 52 (e.g., a conductive outer braid conductor). Other arrangements may be used for coupling transceivers in device 10 to antenna 40 if desired. The arrangement of FIG. 3 is merely illustrative.

As the cross-sectional view of FIG. 3 makes clear, the sidewalls of housing 12 that are formed by bezel 16 may be relatively tall. At the same time, the amount of area that is available to form an antenna in region 20 at the lower end of device 10 may be limited, particularly in a compact device. The compact size that is desired form forming the antenna may make it difficult to form a slot-type antenna shape of sufficient size to resonant in desired communications bands. The shape of bezel 16 may tend to reduce the efficiency of conventional planar inverted-F antennas. Challenges such as these may, if desired, be addressed using a loop-type design for antenna 40.

Figure 4:
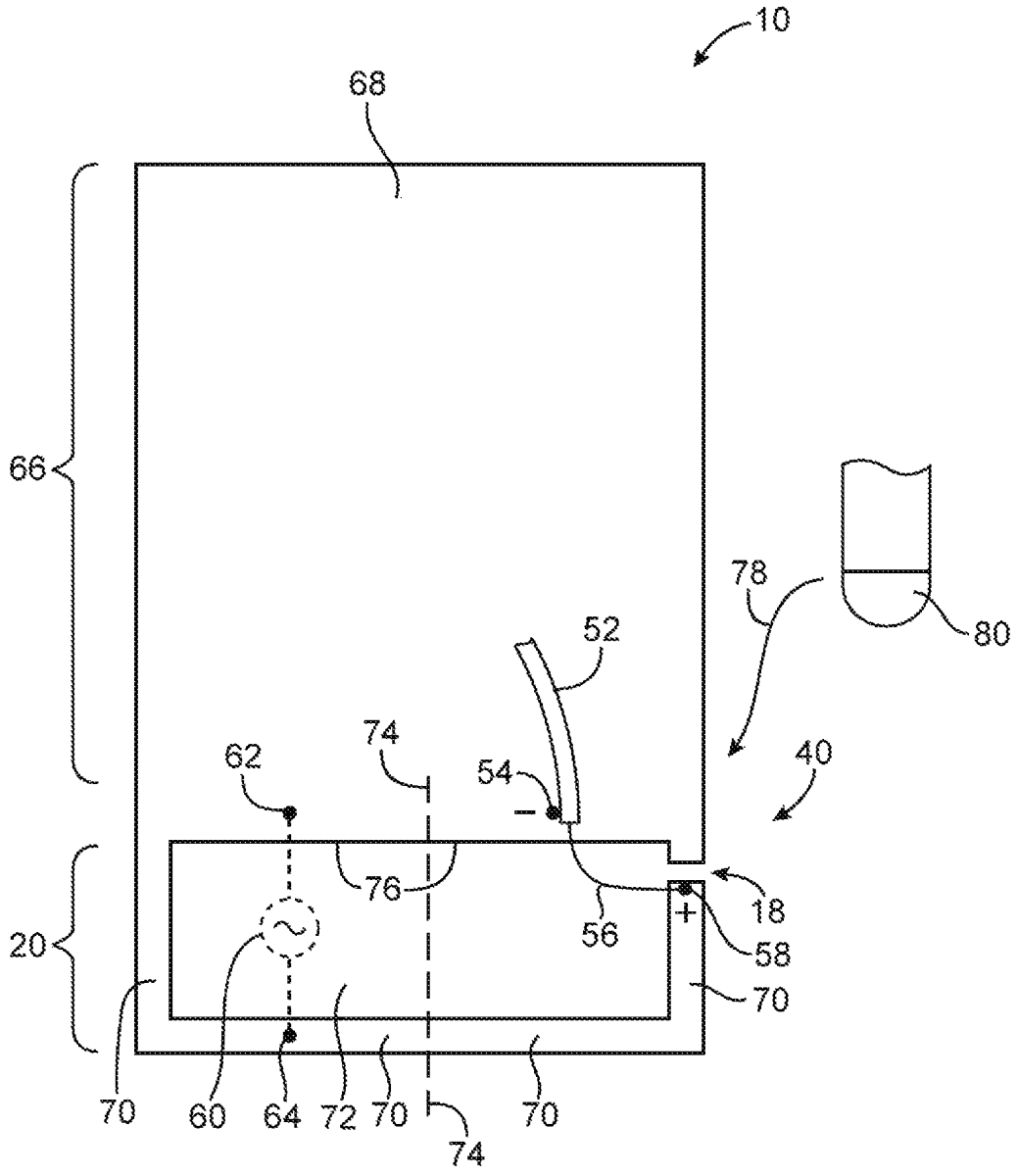
FIG. 4 is a diagram of an illustrative antenna in accordance with an embodiment of the present invention.

Consider, as an example, the antenna arrangement of FIG. 4. As shown in FIG. 4, antenna 40 may be formed in region 20 of device 10. Region 20 may be located at the lower end of device 10, as described in connection with FIG. 1. Conductive region 68, which may sometimes be referred to as a ground plane or ground plane element, may be formed from one or more conductive structures (e.g., planar conductive traces on printed circuit board 46, internal structural members in device 10, electrical components 44 on board 46, radio-frequency shielding cans mounted on board 46, etc.). Conductive region 68 in region 66 is sometimes referred to as forming a "ground region" for antenna 40. Conductive structures 70 of FIG. 4 may be formed by bezel 16. Regions 70 are sometimes referred to as ground plane extensions. Gap 18 may be formed in this conductive bezel portion (as shown in FIG. 1).

Ground plane extensions 70 (i.e., portions of bezel 16) and the portions of region 68 that lie along edge 76 of ground region 68 form a conductive loop around opening 72. Opening 72 may be formed from air, plastics and other solid dielectrics. If desired, the outline of opening 72 may be curved, may have more than four straight segments, and/or may be defined by the outlines of conductive components. The rectangular shape of dielectric region 72 in FIG. 4 is merely illustrative.

The conductive structures of FIG. 4 may, if desired, be fed by coupling radio-frequency transceiver 60 across ground antenna feed terminal 62 and positive antenna feed terminal 64. As shown in FIG. 4, in this type of arrangement, the feed for antenna 40 is not located in the vicinity of gap 18 (i.e., feed terminals 62 and 64 are located to the left of laterally centered dividing line 74 of opening 72, whereas gap 18 is located to the right of dividing line 74 along the right-hand side of device 10). While this type of arrangement may be satisfactory in some situations, antenna feed arrangements that locate the antenna feed terminals at the locations of terminals 62 and 64 of FIG. 4 tend to accentuate the electric field strength of the radio-frequency antenna signals in the vicinity of gap 18. If a user happens to place an external object such as finger 80 into the vicinity of gap 18 by moving finger 80 in direction 78 (e.g., when grasping device 10 in the user's hand), the presence of the user's finger may disrupt the operation of antenna 40.

To ensure that antenna 40 is not overly sensitive to touch (i.e., to desensitize antenna 40 to touch events involving the hand of the user of device 10 and other external objects), antenna 40 may be fed using antenna feed terminals located in the vicinity of gap 18 (e.g., where shown by positive antenna feed terminal 58 and ground antenna feed terminal 54 in the FIG. 4 example). When the antenna feed is located to the right of line 74 and, more particularly, when the antenna feed is located close to gap 18, the electric fields that are produced at gap 18 tend to be reduced. This helps minimize the sensitivity of antenna 40 to the presence of the user's hand, ensuring satisfactory operation regardless of whether or not an external object is in contact with device 10 in the vicinity of gap 18.

Figure 5:
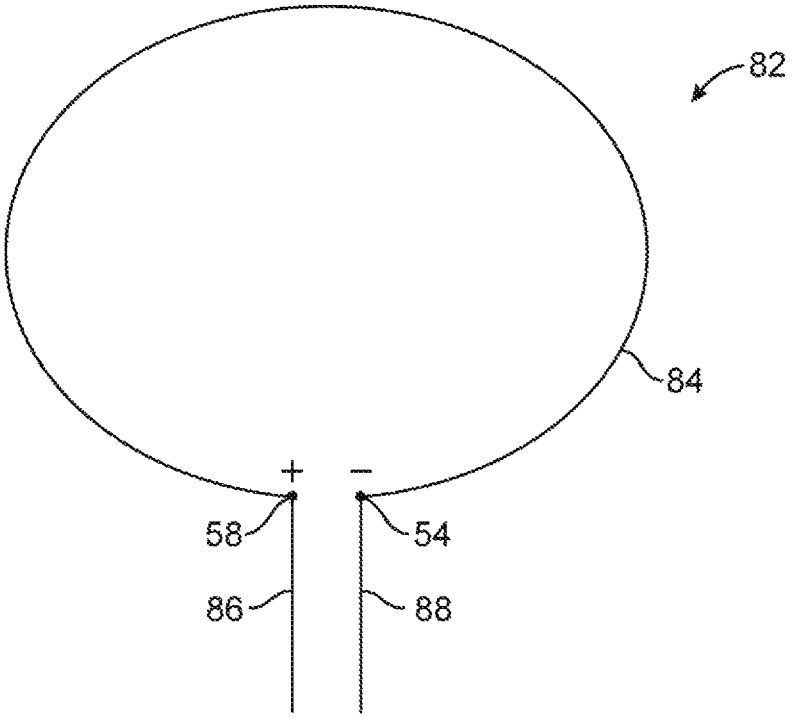
FIG. 5 is a schematic diagram of an illustrative series-fed loop antenna that may be used in an electronic device in accordance with an embodiment of the present invention.

In the arrangement of FIG. 4, antenna 40 is being series fed. A schematic diagram of a series-fed loop antenna of the type shown in FIG. 4 is shown in FIG. 5. As shown in FIG. 5, series-fed loop antenna 82 may have a loop-shaped conductive path such as loop 84. A transmission line composed of positive transmission line conductor 86 and ground transmission line conductor 88 may be coupled to antenna feed terminals 58 and 54, respectively.

It may be challenging to effectively use a series-fed feed arrangement of the type shown in FIG. 5 to feed a multi-band loop antenna. For example, it may be desired to operate a loop antenna in a lower frequency band that covers the GSM sub-bands at 850 MHz and 900 MHz and a higher frequency band that covers the GSM sub-bands at 1800 MH and 1900 MHz and the data sub-band at 2100 MHz. This type of arrangement may be considered to be a dual band arrangement (e.g., 850/900 for the first band and 1800/1900/2100 for the second band) or may be considered to have five bands (850, 900, 1800, 1900, and 2100). In multi-band arrangements such as these, series-fed antennas such as loop antenna 82 of FIG. 5 may exhibit substantially better impedance matching in the high-frequency communications band than in the low-frequency communications band.

Figure 6:
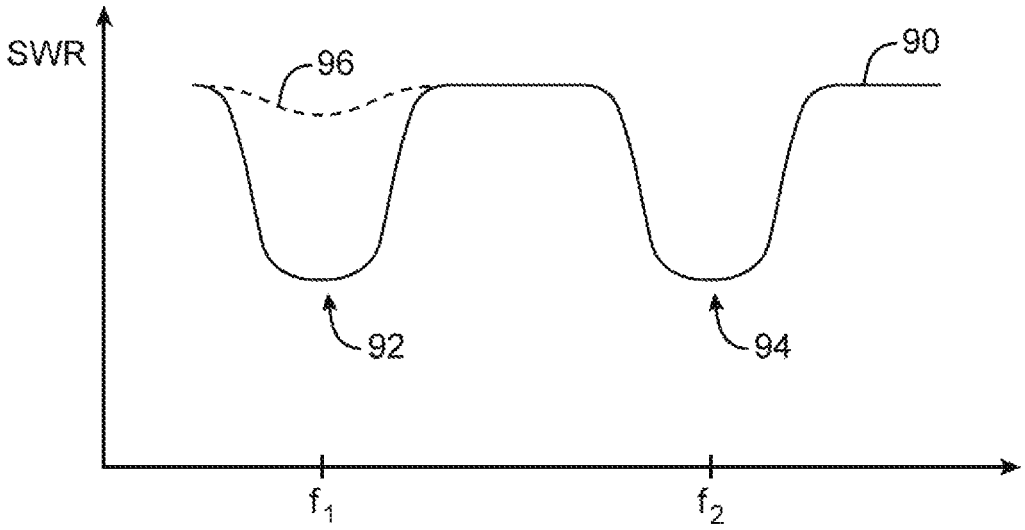
FIG. 6 is a graph showing how an electronic device antenna may be configured to exhibit coverage in multiple communications bands in accordance with an embodiment of the present invention.

A standing-wave-ratio (SWR) versus frequency plot that illustrates this effect is shown in FIG. 6. As shown in FIG. 6, SWR plot 90 may exhibit a satisfactory resonant peak (peak 94) at high-band frequency f2 (e.g., to cover the sub-bands at 1800 MHz, 1900 MHz, and 2100 MHz). SWR plot 90 may, however, exhibit a relatively poor performance in the low-frequency band centered at frequency f1 when antenna 40 is series fed. For example, SWR plot 90 for a series-fed loop antenna 82 of FIG. 5 may be characterized by weak resonant peak 96. As this example demonstrates, series-fed loop antennas may provide satisfactory impedance matching to transmission line 52 (FIG. 3) in a higher frequency band at f2, but may not provide satisfactory impedance matching to transmission line 52 (FIG. 3) in lower frequency band f1.

A more satisfactory level of performance (illustrated by low-band resonant peak 92) may be obtained using a parallel-fed arrangement with appropriate impedance matching features.

Figure 7:
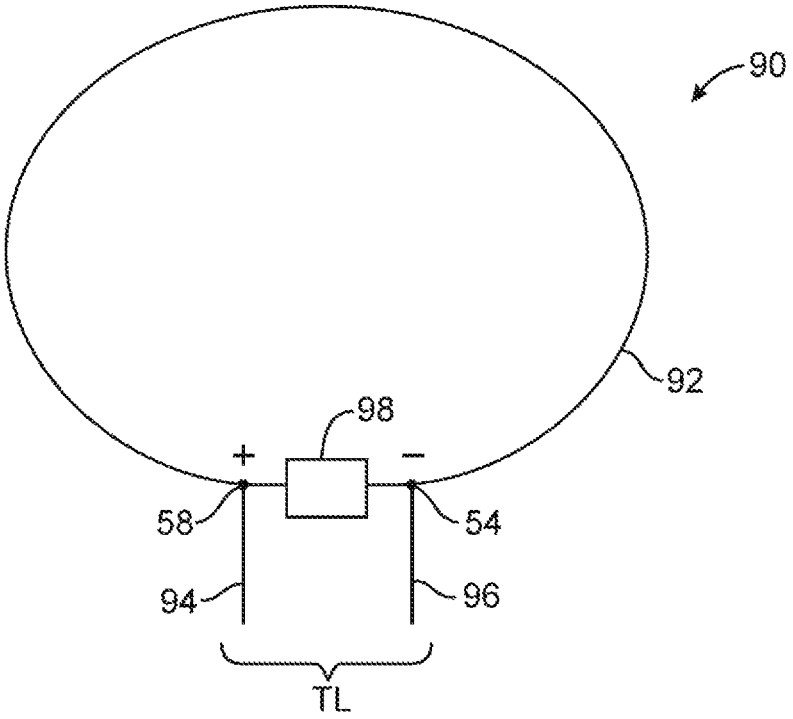
FIG. 7 is a schematic diagram of an illustrative parallel-fed loop antenna that may be used in an electronic device in accordance with an embodiment of the present invention.

An illustrative parallel-fed loop antenna is shown schematically in FIG. 7. As shown in FIG. 7, parallel-fed loop antenna 90 may have a loop of conductor such as loop 92. Loop 92 in the FIG. 7 example is shown as being circular. This is merely illustrative. Loop 92 may have other shapes if desired (e.g., rectangular shapes, shapes with both curved and straight sides, shapes with irregular borders, etc.). Transmission line TL may include positive signal conductor 94 and ground signal conductor 96. Paths 94 and 96 may be contained in coaxial cables, micro-strip transmission lines on flex circuits and rigid printed circuit boards, etc. Transmission line TL may be coupled to the feed of antenna 90 using positive antenna feed terminal 58 and ground antenna feed terminal 54. Electrical element 98 may bridge terminals 58 and 54, thereby "closing" the loop formed by path 92. When the loop is closed in this way, element 98 is interposed in the conductive path that forms loop 92. The impedance of parallel-fed loop antennas such as loop antenna 90 of FIG. 7 may be adjusted by proper selection of the element 98 and, if desired, other circuits (e.g., capacitors or other elements interposed in one of the feed lines such as line 94 or line 96).

Element 98 may be formed from one or more electrical components. Components that may be used as all or part of element 98 include resistors, inductors, and capacitors. Desired resistances, inductances, and capacitances for element 98 may be formed using integrated circuits, using discrete components and/or using dielectric and conductive structures that are not part of a discrete component or an integrated circuit. For example, a resistance can be formed using thin lines of a resistive metal alloy, capacitance can be formed by spacing two conductive pads close to each other that are separated by a dielectric, and an inductance can be formed by creating a conductive path on a printed circuit board. These types of structures may be referred to as resistors, capacitors, and/or inductors or may be referred to as capacitive antenna feed structures, resistive antenna feed structures and/or inductive antenna feed structures.

Figure 8:
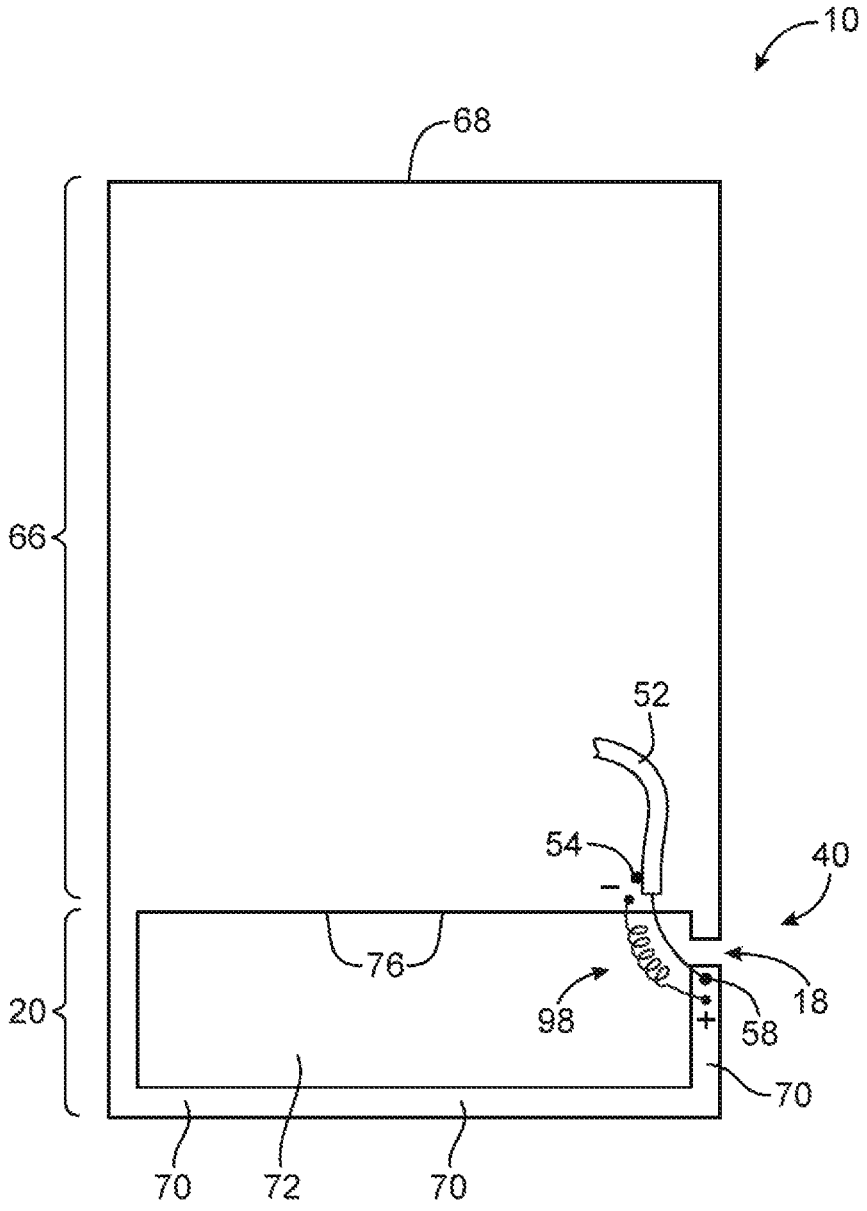
FIG. 8 is a diagram of an illustrative parallel-feed loop antenna with an inductance interposed in the loop in accordance with an embodiment of the present invention.

An illustrative configuration for antenna 40 in which component 98 of the schematic diagram of FIG. 7 has been implemented using an inductor is shown in FIG. 8. As shown in FIG. 8, loop 92 (FIG. 7) may be implemented using conductive regions 70 and the conductive portions of region 68 that run along edge 76 of opening 72. Antenna 40 of FIG. 8 may be fed using positive antenna feed terminal 58 and ground antenna feed terminal 54. Terminals 54 and 58 may be located in the vicinity of gap 18 to reduce electric field concentrations in gap 18 and thereby reduce the sensitivity of antenna 40 to touch events.

Figure 9:
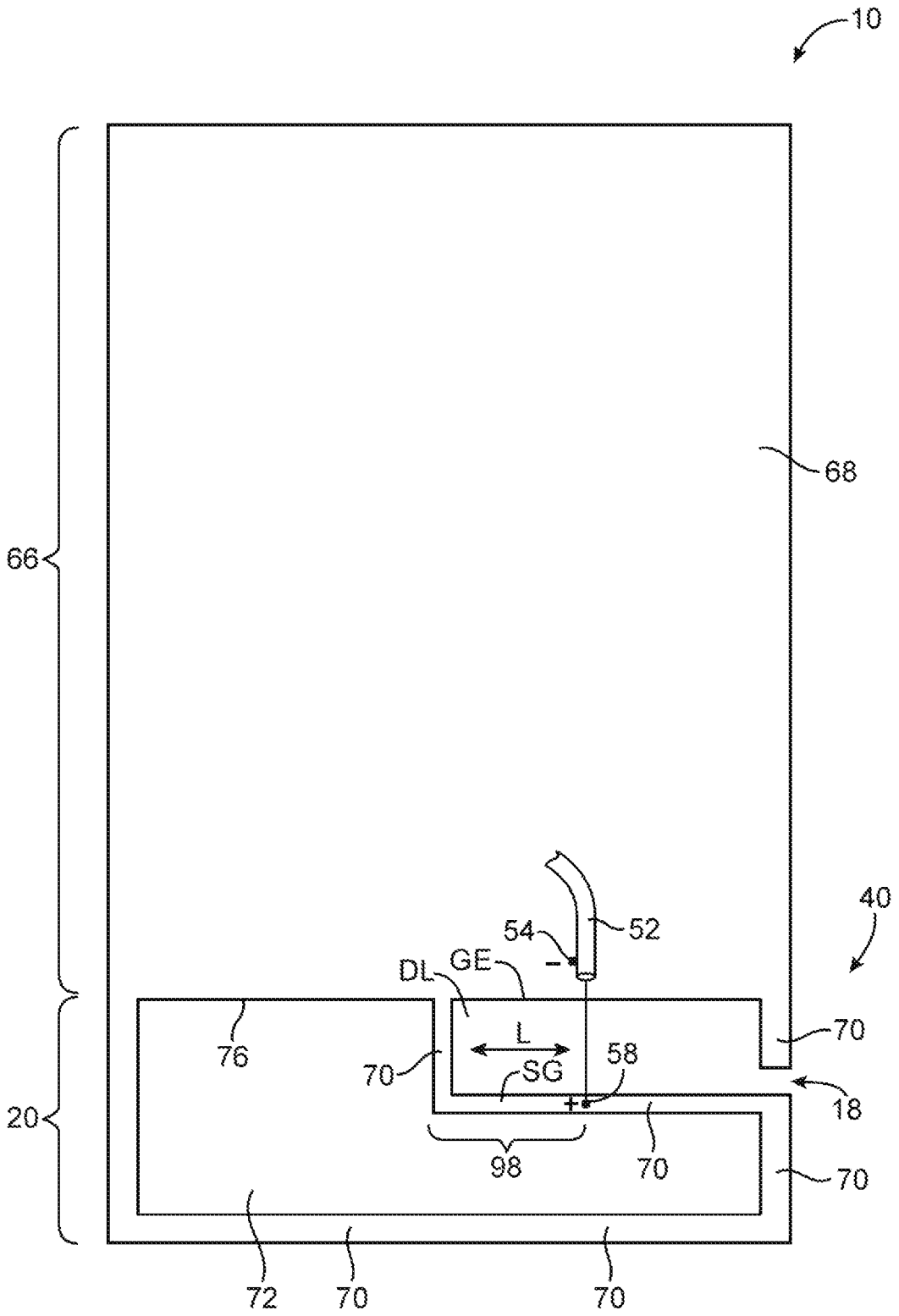
FIG. 9 is a diagram of an illustrative parallel-fed loop antenna having an inductive transmission line structure in accordance with an embodiment of the present invention.

The presence of inductor 98 may at least partly help match the impedance of transmission line 52 to antenna 40. If desired, inductor 98 may be formed using a discrete component such as a surface mount technology (SMT) inductor. The inductance of inductor 98 may also be implemented using an arrangement of the type shown in FIG. 9. With the configuration of FIG. 9, the loop conductor of parallel-fed loop antenna 40 may have an inductive segment SG that runs parallel to ground plane edge GE. Segment SG may be, for example, a conductive trace on a printed circuit board or other conductive member. A dielectric opening DL (e.g., an air-filled or plastic-filled opening) may separate edge portion GE of ground 68 from segment SG of conductive loop portion 70. Segment SG may have a length L. Segment SG and associated ground GE form a transmission line with an associated inductance (i.e., segment SG and ground GE form inductor 98). The inductance of inductor 98 is connected in parallel with feed terminals 54 and 58 and therefore forms a parallel inductive tuning element of the type shown in FIG. 8. Because inductive element 98 of FIG. 9 is formed using a transmission line structure, inductive element 98 of FIG. 9 may introduce fewer losses into antenna 40 than arrangements in which a discrete inductor is used to bridge the feed terminals. For example, transmission-line inductive element 98 may preserve high-band performance (illustrated as satisfactory resonant peak 94 of FIG. 6), whereas a discrete inductor might reduce high-band performance.

Figure 10:
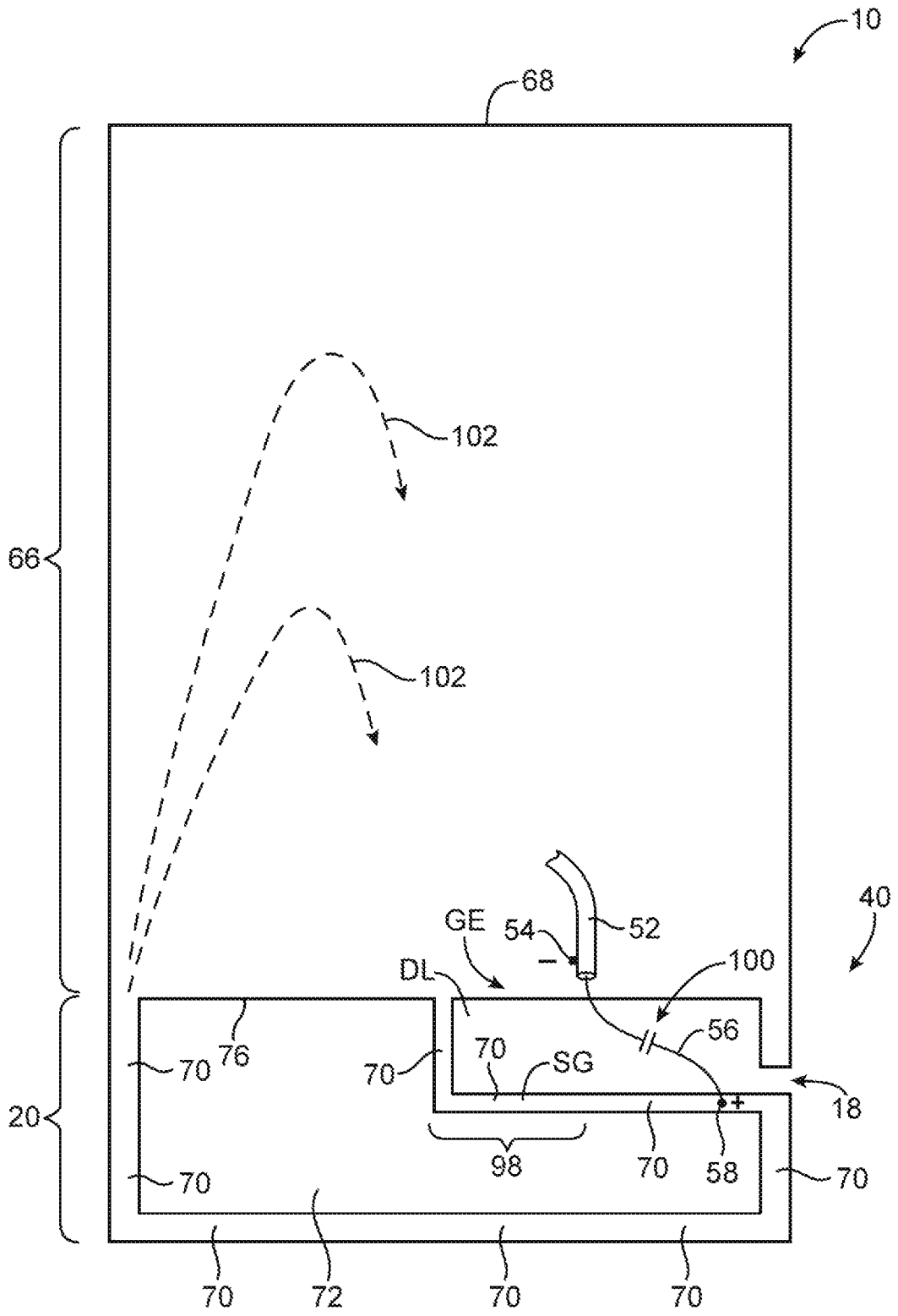
FIG. 10 is a diagram of an illustrative parallel-fed loop antenna with an inductive transmission line structure and a series-connected capacitive element in accordance with an embodiment of the present invention.

Capacitive tuning may also be used to improve impedance matching for antenna 40. For example, capacitor 100 of FIG. 10 may be connected in series with center conductor 56 of coaxial cable 52 or other suitable arrangements can be used to introduce a series capacitance into the antenna feed. As shown in FIG. 10, capacitor 100 may be interposed in coaxial cable center conductor 56 or other conductive structures that are interposed between the end of transmission line 52 and positive antenna feed terminal 58. Capacitor 100 may be formed by one or more discrete components (e.g., SMT components), by one or more capacitive structures (e.g., overlapping printed circuit board traces that are separated by a dielectric, etc.), lateral gaps between conductive traces on printed circuit boards or other substrates, etc.

The conductive loop for loop antenna 40 of FIG. 10 is formed by conductive structures 70 and the conductive portions of ground conductive structures 66 along edge 76. Loop currents can also pass through other portions of ground plane 68, as illustrated by current paths 102. Positive antenna feed terminal 58 is connected to one end of the loop path and ground antenna feed terminal 54 is connected to the other end of the loop path. Inductor 98 bridges terminals 54 and 58 of antenna 40 of FIG. 10, so antenna 40 forms a parallel-fed loop antenna with a bridging inductance (and a series capacitance from capacitor 100).

During operation of antenna 40, a variety of current paths 102 of different lengths may be formed through ground plane 68. This may help to broaden the frequency response of antenna 40 in bands of interest. The presence of tuning elements such as parallel inductance 98 and series capacitance 100 may help to form an efficient impedance matching circuit for antenna 40 that allows antenna 40 to operate efficiently at both high and low bands (e.g., so that antenna 40 exhibits high-band resonance peak 94 of FIG. 6 and low-band resonance peak 92 of FIG. 6).

Figure 11:
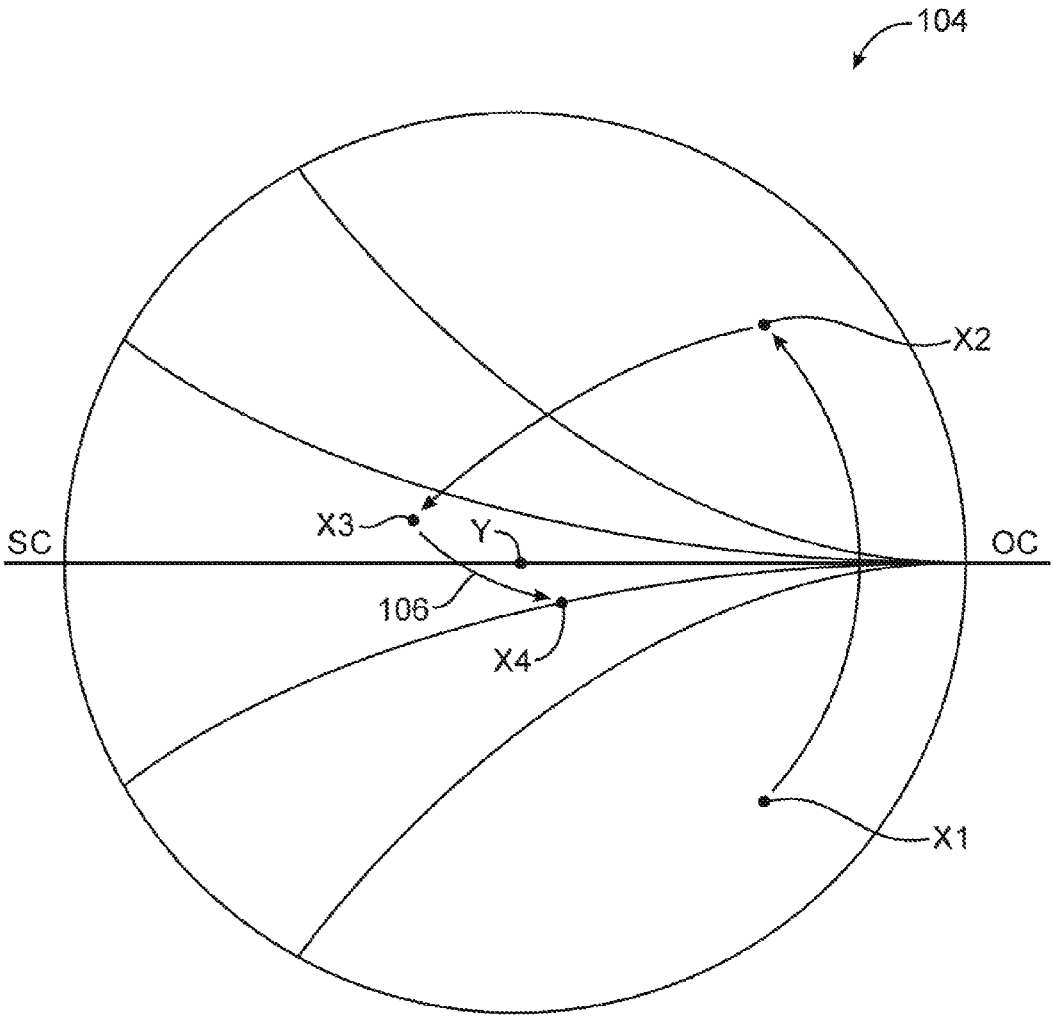
FIG. 11 is a Smith chart illustrating the performance of various electronic device loop antennas in accordance with embodiments of the present invention.

A simplified Smith chart showing the possible impact of tuning elements such as inductor 98 and capacitor 100 of FIG. 10 on parallel-fed loop antenna 40 is shown in FIG. 11. Point Y in the center of chart 104 represents the impedance of transmission line 52 (e.g., a 50 ohm coaxial cable impedance to which antenna 40 is to be matched). Configurations in which the impedance of antenna 40 is close to point Y in both the low and high bands will exhibit satisfactory operation.

With parallel-fed antenna 40 of FIG. 10, high-band matching is relatively insensitive to the presence or absence of inductive element 98 and capacitor 100. However, these components may significantly affect low band impedance. Consider, as an example, an antenna configuration without either inductor 98 or capacitor 100 (i.e., a parallel-fed loop antenna of the type shown in FIG. 4). In this type of configuration, the low band (e.g., the band at frequency f1 of FIG. 6) may be characterized by an impedance represented by point X1 on chart 104. When an inductor such as parallel inductance 98 of FIG. 9 is added to the antenna, the impedance of the antenna in the low band may be characterized by point X2 of chart 104. When a capacitor such as capacitor 100 is added to the antenna, the antenna may be configured as shown in FIG. 10. In this type of configuration, the impedance of the antenna 40 may be characterized by point X3 of chart 104.

At point X3, antenna 40 is well matched to the impedance of cable 50 in both the high band (frequencies centered about frequency f2 in FIG. 6) and the low band (frequencies centered about frequency f1 in FIG. 6). This may allow antenna 40 to support desired communications bands of interest. For example, this matching arrangement may allow antennas such as antenna 40 of FIG. 10 to operate in bands such as the communications bands at 850 MHz and 900 MHz (collectively forming the low band region at frequency f1) and the communications bands at 1800 MHz, 1900 MHz, and 2100 MHz (collectively forming the high band region at frequency f2).

Moreover, the placement of point X3 helps ensure that detuning due to touch events is minimized. When a user touches housing 12 of device 10 in the vicinity of antenna 40 or when other external objects are brought into close proximity with antenna 40, these external objects affect the impedance of the antenna. In particular, these external objects may tend to introduce a capacitive impedance contribution to the antenna impedance. The impact of this type of contribution to the antenna impedance tends to move the impedance of the antenna from point X3 to point X4, as illustrated by line 106 of chart 104 in FIG. 11. Because of the original location of point X3, point X4 is not too far from optimum point Y. As a result, antenna 40 may exhibit satisfactory operation under a variety of conditions (e.g., when device 10 is being touched, when device 10 is not being touched, etc.).

Although the diagram of FIG. 11 represents impedances as points for various antenna configurations, the antenna impedances are typically represented by a collection of points (e.g., a curved line segment on chart 104) due to the frequency dependence of antenna impedance. The overall behavior of chart 104 is, however, representative of the behavior of the antenna at the frequencies of interest. The use of curved line segments to represent frequency-dependent antenna impedances has been omitted from FIG. 11 to avoid over-complicating the drawing.

Antenna 40 of the type described in connection with FIG. 10 may be capable of supporting wireless communications in first and second radio-frequency bands (see, e.g., FIG. 6). For example, antenna 40 may be operable in a lower frequency band that covers the GSM sub-bands at 850 MHz and 900 MHz and a higher frequency band that covers the GSM sub-bands at 1800 MHz and 1900 MHz and the data sub-band at 2100 MHz.

It may be desirable for device 10 to be able to support other wireless communications bands in addition to the first and second bands. For example, it may be desirable for antenna 40 to be capable of operating in a higher frequency band that covers the GSM sub-bands at 1800 MHz and 1900 MHz and the data sub-band at 2100 MHz, a first lower frequency band that covers the GSM sub-bands at 850 MHz and 900 MHz, and a second lower frequency band that covers the LTE band at 700 MHz, the GSM sub-bands at 710 MHz and 750 MHz, the UMTS sub-band at 700 MHz, and other desired wireless communications bands.

The band coverage of antenna 40 of the type described in connection of FIG. 10 may be limited by the volume (e.g., the volume of the opening defined by conductive loop 70) of loop antenna 40. In general, for a loop antenna having a given volume, a higher band coverage (or bandwidth) results in a decrease in gain (e.g., the product of maximum gain and bandwidth is constant).

Figure 12:
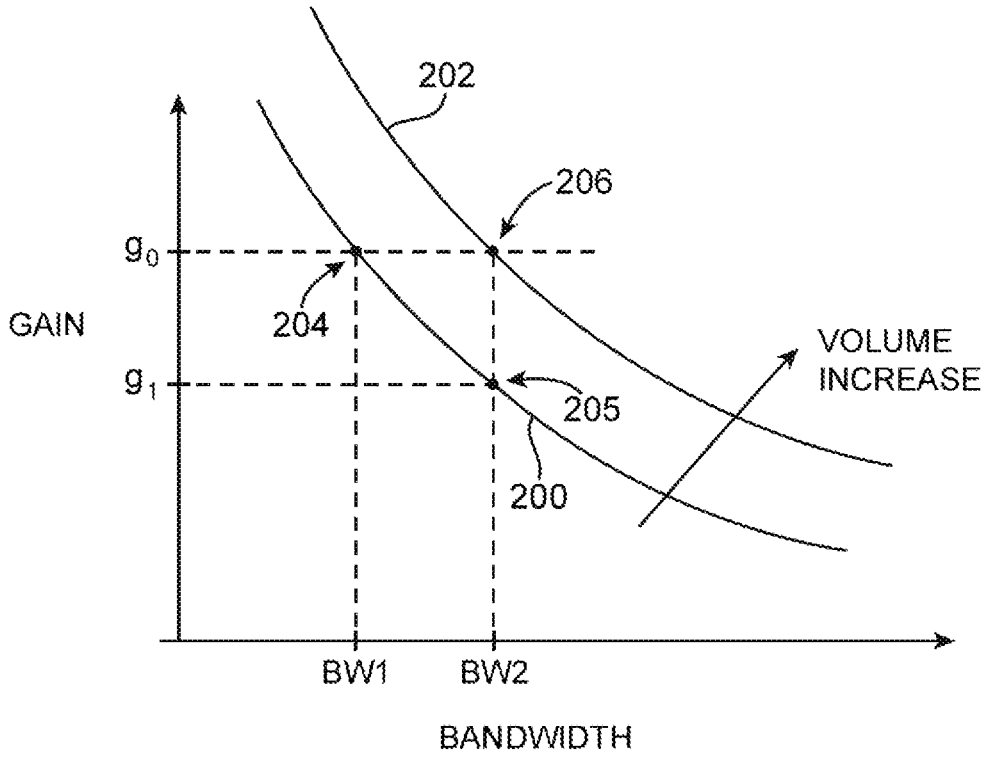
FIG. 12 is plot showing trade-offs between antenna gain and antenna bandwidth for a given antenna volume.

FIG. 12 is a graph showing how antenna gain varies as a function of antenna bandwidth. Curve 200 represents a gain-bandwidth characteristic for a first loop antenna having a first volume, whereas curve 202 represents a gain-bandwidth characteristic for a second loop antenna having a second volume that is greater than the first volume. The first and second loop antennas may be antennas of the type described in connection with FIG. 10.

As shown in FIG. 12, the first loop antenna can provide bandwidth BW1 while exhibiting gain $g_0$ (point 204). In order to provide more bandwidth (i.e., bandwidth BW2) with the first loop antenna, the gain of the first loop antenna would be lowered to gain $g_1$ (point 205). One way of providing more band coverage is to increase the volume of the loop antenna. For example, the second loop antenna having a greater volume than the volume of the first loop antenna is capable of providing bandwidth BW2 while exhibiting $g_0$ (point 206). Increasing the volume of loop antennas, however, may not always be feasible if a small form factor is desired.

In another suitable arrangement, the wireless circuitry of device 10 may include tunable (configurable) antenna circuitry. The tunable antenna circuitry may allow antenna 40 to be operable in at least three wireless communications bands (as an example). The tunable antenna circuitry may include a switchable inductor circuit such as circuit 210, tunable matching network circuitry such as matching circuitry M1, a variable capacitor circuit such as circuit 212, and other suitable tunable circuits (see, e.g., FIG. 13).

Figure 13:
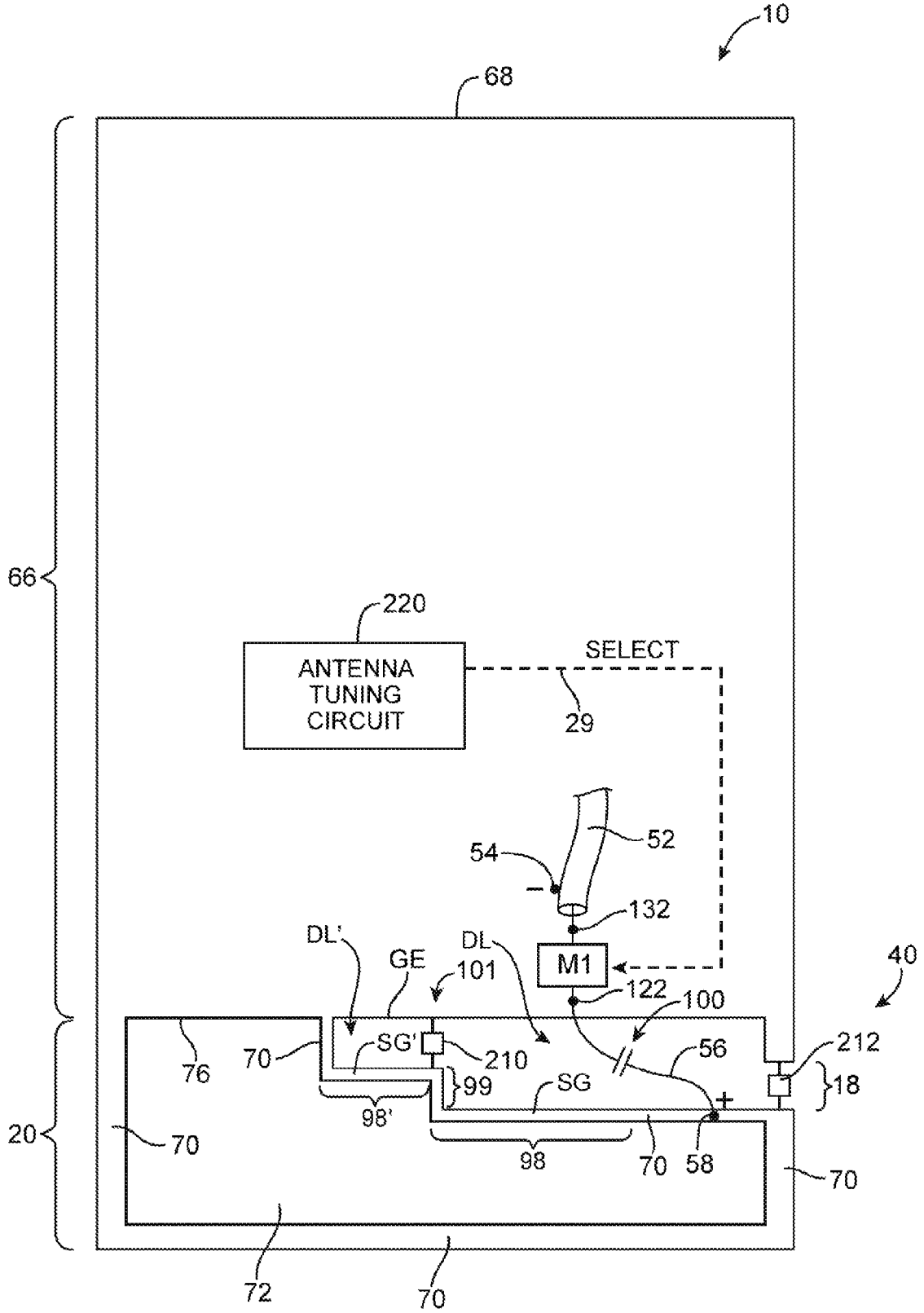
FIG. 13 is a diagram of an illustrative parallel-fed loop antenna with tunable antenna circuitry in accordance with an embodiment of the present invention.

As shown in FIG. 13, loop conductor 70 of parallel-fed loop antenna 40 may have a first inductive segment SG and a second inductive segment SG' that run parallel to ground plane edge GE. Segments SG and SG' may be, for example, conductive traces on a printed circuit board or other conductive member. Dielectric opening DL (e.g., an air-filled or plastic-filled opening) may separate edge portion GE of ground 68 from segment SG of conductive loop portion 70, whereas dielectric opening DL' may separate edge portion GE of ground 68 from segment SG' of conductive loop portion 70. Dielectric openings DL and DL' may have different shapes and sizes.

Segment SG and SG' may be connected through a portion 99 of conductor 70 that runs perpendicular to ground plane edge GE. Switchable inductor circuit (also referred to as tunable inductor circuit, configurable inductor circuit, or adjustable inductor circuit) 210 may be coupled between portion 99 and a corresponding terminal 101 on ground plane edge GE. When circuit 210 is switched into use (e.g., when circuit 210 is turned on), segment SG and associated ground GE form a first transmission line path with a first inductance (i.e., segment SG and ground GE form inductor 98). When circuit 210 is switched out of use (e.g., when circuit 210 is turned off), segment SG, portion 99, segment SG', and ground GE collective form a second transmission line path with a second inductance (i.e., segment SG' and ground GE form inductor 98' that is coupled in series with inductor 98). The second transmission line path may sometimes be referred to as being a fixed inductor, because the inductance of the second transmission line path is fixed when switchable inductor 210 is not in use. Switchable inductor 210 serves to shunt the second transmission line path so that the first inductance value is lower than the second inductance value.

The dimensions of segments SG and SG' are selected so that the equivalent inductance values for the first and second inductances are equal to 18 nH and 20 nH, respectively (as an example). The first transmission line path (if circuit 210 is enabled) and the second transmission line path (if circuit 210 is disabled) are connected in parallel with feed terminals 54 and 58 and serve as parallel inductive tuning elements for antenna 40. The first and second transmission line path may therefore sometimes be referred to as a variable inductor. Because the first and second inductances are provided using transmission line structures, the first and second transmission line paths may preserve high-band performance (illustrated as satisfactory resonant peak 94 of FIG. 6), whereas discrete inductors might reduce high-band performance.

The presence of inductor 98 may at least partly help match the impedance of transmission line 52 to antenna 40 when circuit 210 is turned on, whereas the presence of the series-connected inductors 98 and 98' may party help match the impedance of line 52 to antenna 40 when circuit 210 is turned off. If desired, inductors 98 and 98' may be formed using discrete components such as surface mount technology (SMT) inductors. Inductors 98 and 98' have inductance values that are carefully chosen to provide desired band coverage.

In another suitable embodiment, tunable matching network circuitry M1 may be coupled between the coaxial cable 52 and capacitor 100. For example, tunable circuitry M1 may have a first terminal 132 connected to the coaxial cable center conductor and a second terminal 122 connected to capacitor 100. Impedance matching circuitry M1 may be formed using conductive structures with associated capacitance, resistance, and inductance values, and/or discrete components such as inductors, capacitors, and resistors that form circuits to match the impedances of transceiver circuitry 38 and antenna 40.

Matching circuitry M1 may be fixed or adjustable. In this type of configuration, a control circuit such as antenna tuning circuit 220 may issue control signals such as signal SELECT on path 29 to configure matching circuitry M1. When SELECT has a first value, matching circuitry M1 may be placed in a first configuration. When SELECT has a second value, matching circuitry M1 may be placed in a second configuration. The state of matching circuitry M1 may serve to tune antenna 40 so that desired communications bands are covered by antenna 40.

In another suitable embodiment, a variable capacitor circuit (sometimes referred to as a varactor circuit, a tunable capacitor circuit, an adjustable capacitor circuit, etc.) 212 may be coupled between conductive bezel gap 18. Bezel gap 18 may, for example, have an intrinsic capacitance of 1 pF (e.g., an inherent capacitance value formed by the parallel conductive surfaces at gap 18). Component 212 may be, for example, a continuously variable capacitor, a semi continuously adjustable capacitor that has two to four or more different capacitance values that can be coupled in parallel to the intrinsic capacitance. If desired, component 212 may be a continuously variable inductor or a semi continuously adjustable inductor that has two to four or more different inductance values. The capacitance value of component 212 may serve to fine tune antenna 40 for operation at desired frequencies.

Figure 14:
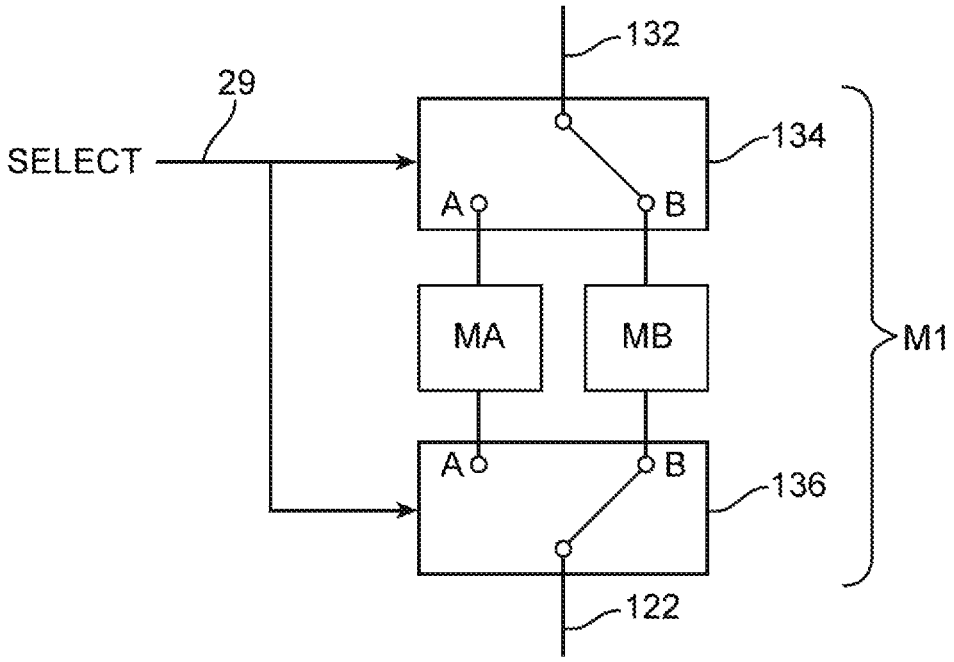
FIG. 14 is a circuit diagram of an illustrative tunable matching circuit of the type that may be used in connection with the antenna of FIG. 13 in accordance with an embodiment of the present invention.

Illustrative tunable circuitry that may be used for implementing tunable matching circuitry M1 of FIG. 13 is shown in FIG. 14. As shown in FIG. 14, matching circuitry M1 may have switches such as switches 134 and 136. Switches 134 and 136 may have multiple positions (shown by the illustrative A and B positions in FIG. 14). When signal SELECT has a first value, switches 134 and 136 may be put in their A positions and matching circuit MA may be switched into use. When signal SELECT has a second value, switches 134 and 136 may be placed in their B positions (as shown in FIG. 14), so that matching circuit MB is connected between paths 132 and 122.

Figure 15:
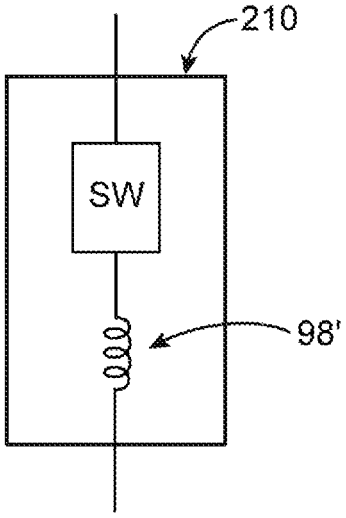
FIG. 15 is a circuit diagram of an illustrative switchable inductor circuit of the type that may be used in connection with the antenna of FIG. 13 in accordance with an embodiment of the present invention.

FIG. 15 shows one suitable circuit implementation of switchable inductor circuit 210. As shown in FIG. 15, circuit 210 includes a switch SW and inductive element 98' coupled in series. Switch SW may be implemented using a p-i-n diode, a gallium arsenide field-effect transistor (FET), a microelectromechanical systems (MEMs) switch, a metal-oxide-semiconductor field-effect transistor (MOSFET), a high-electron mobility transistor (HEMT), a pseudomorphic HEMT (PHEMT), a transistor formed on a silicon-on-insulator (SOI) substrate, etc.

Inductive element 98' may be formed from one or more electrical components. Components that may be used as all or part of element 98' include resistors, inductors, and capacitors. Desired resistances, inductances, and capacitances for element 98' may be formed using integrated circuits, using discrete components (e.g., a surface mount technology inductor) and/or using dielectric and conductive structures that are not part of a discrete component or an integrated circuit. For example, a resistance can be formed using thin lines of a resistive metal alloy, capacitance can be formed by spacing two conductive pads close to each other that are separated by a dielectric, and an inductance can be formed by creating a conductive path (e.g., a transmission line) on a printed circuit board.

Figure 16:
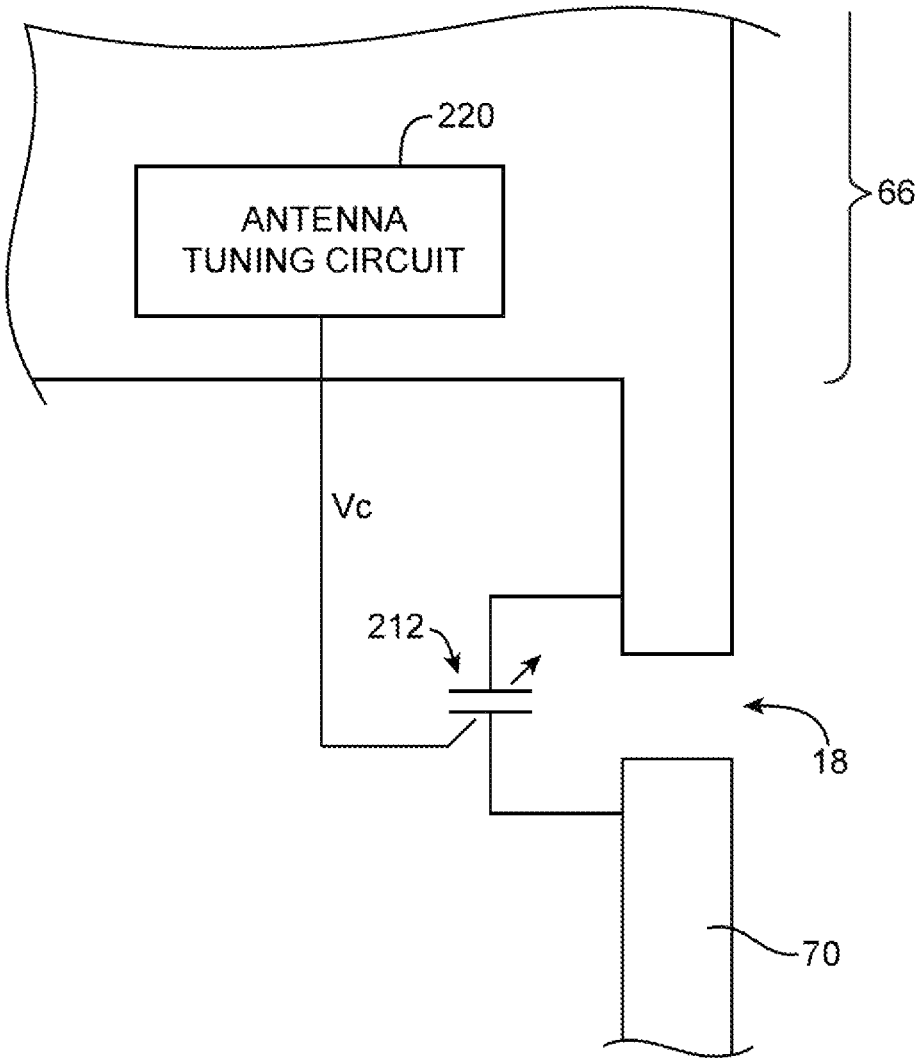
FIG. 16 is a circuit diagram of an illustrative variable capacitor circuit of the type that may be used in connection with the antenna of FIG. 13 in accordance with an embodiment of the present invention.

FIG. 16 shows how varactor circuit 212 may receive control voltage signal Vc from antenna tuning circuit 220.

As shown in FIG. 16, varactor circuit 212 may have a first terminal connected to one end of bezel gap 18, a second terminal connected to another end of bezel gap 18, and a third terminal that receives control signal Vc. Antenna tuning circuit 220 may bias Vc to different voltage levels to adjust the capacitance of varactor 212. Varactor 212 may be formed from using integrated circuits, one or more discrete components (e.g., SMT components), etc.

Figure 17:
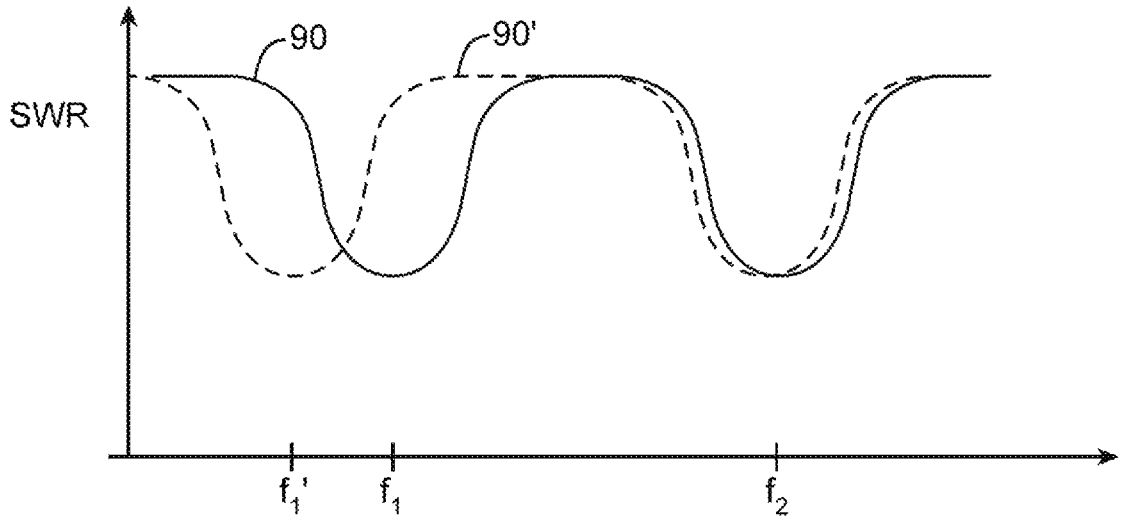
FIG. 17 is a plot showing how the low band portions of the antenna of FIG. 13 may be used to cover multiple communications bands of interest using tunable antenna circuitry in accordance with an embodiment of the present invention.

By using antenna tuning schemes of the type described in connection with FIGS. 13-16, antenna 40 may be able to cover a wider range of communications frequencies than would otherwise be possible. FIG. 17 shows an illustrative SWR plot for antenna 40 of the type described in connection with of FIG. 13. The solid line 90 corresponds to a first mode of antenna 40 when inductive circuit 220 is enabled. In this first mode, antenna 40 can operate in bands at a first low-band region at frequency f1 (e.g., to cover the GSM bands at 850 MHz and 900 MHz) and in bands at a high-band region at frequency f2 (e.g., to cover the GSM bands at 1800 MHz, 1900 MHz, and 2100 MHz).

The dotted line 90' corresponds to a second mode of antenna 40 when inductive circuit 220 is disabled. In this second mode, antenna 40 can operate in bands at a second low-band region at frequency f1' (e.g., to cover the LTE band at 700 MHz and other bands of interest) while preserving coverage at the high-band region at frequency f2. Tunable matching circuitry M1 may be configured to provide coverage at the desired sub-band.

Varactor circuit 212 may be used to fine tune antenna 40 prior to operation of device 10 or in real-time so that antenna 40 performs as desired under a variety of wireless traffic and environmental scenarios and to compensate for process, voltage, and temperature variations, and other sources of noise, interference, or variation.

The foregoing is merely illustrative of the principles of this invention and various modifications can be made by those skilled in the art without departing from the scope and spirit of the invention.

What is claimed is:

1. A parallel-fed loop antenna in an electronic device having a periphery, comprising:

an antenna feed that includes first and second antenna feed terminals;

a conductive loop coupled between the first and second antenna feed terminals, wherein the conductive loop is formed at least partly from conductive structures disposed along the periphery; and a variable inductor that bridges the first and second antenna feed terminals, wherein the variable inductor is coupled in parallel between the first and second antenna feed terminals, wherein the variable inductor comprises:

a first segment, wherein the first segment forms a part of a transmission line path with a first inductance and a first length; and a second segment, wherein the second segment and the first segment form part of a second transmission line path with a second inductance and a second length that is different from the first length.

2. The parallel-fed loop antenna defined in claim 1, wherein the variable inductor comprises a switch that is connected in series with the first segment between the first and second antenna feed terminals, and wherein the second segment and the switch are coupled in parallel between the first segment and the second antenna feed terminal.

3. The parallel-fed loop antenna defined in claim 1, wherein the first inductance is different than the second inductance.

4. The parallel-fed loop antenna defined in claim 1, wherein the conductive structures comprise at least one gap, further comprising:

a variable capacitor circuit that bridges the at least one gap.

5. The parallel-fed loop antenna defined in claim 4, wherein the electronic device further comprises wireless transceiver circuitry and tunable impedance matching circuitry interposed between the transceiver circuitry and the first antenna feed terminal.

6. The parallel-fed loop antenna defined in claim 1, wherein the electronic device further comprises:

wireless transceiver circuitry; and tunable impedance matching circuitry interposed between the transceiver circuitry and the first antenna feeds terminal.

7. The parallel-fed loop antenna defined in claim 1 further comprising:

an antenna feed line that carries antenna signals between a transmission line and the first antenna feed terminal; and a capacitor interposed in the antenna feed line.

8. A handheld electronic device with a length, a width that is shorter than the length, and a height that is shorter than the width, the electronic device comprising:

an antenna feed that includes first and second antenna feed terminals;

a conductive loop coupled between the first and second antenna feed terminals;

wireless transceiver circuitry;

tunable impedance matching circuitry interposed between the wireless transceiver circuitry and the antenna feed;

a housing having a periphery, a top surface, and a bottom surface; and a conductive housing structure, wherein the conductive housing structure extends across the height of the handheld electronic device and runs along the periphery, the conductive housing structure has at least one gap that extends across the height of the electronic device from the top surface of the housing to the bottom surface of the housing, and the conductive loop is formed at least partially from the conductive housing structure.

9. The handheld electronic device defined in claim 8, further comprising:

a variable capacitor circuit that bridges the at least one gap.

10. The handheld electronic device defined in claim 8, wherein the tunable impedance matching circuitry comprises at least two impedance matching network circuits and switching circuitry that configures the tunable impedance matching circuitry to switch into use a selected one of the two impedance matching network circuits.

11. The electronic device defined in claim 8, wherein the antenna feed and the conductive loop form a parallel-fed loop antenna.

12. The electronic device defined in claim 8, further comprising:

a transmission line having positive and ground conductors, wherein the ground conductor is coupled to the second antenna feed terminal and wherein the positive conductor is coupled to the first antenna feed terminal; and a capacitor interposed in the positive conductor of the transmission line.

13. The electronic device defined in claim 8, further comprising:

inductor circuitry that bridges the first and second antenna feed terminals.

14. A wireless electronic device, comprising:

a housing having a periphery;

a conductive structure that runs along the periphery and that has at least one gap on the periphery; and an antenna formed at least partly from the conductive structure, wherein the antenna comprises antenna tuning circuitry that has:

a first configuration that places the antenna in a first operating mode in which the antenna is configured to operate in a first communications band and a second communications band that is higher in frequency than the first communications band; and a second configuration that places the antenna in a second operating mode in which the antenna is configured to operate in a third communications band that is lower in frequency than the first communications band and the second communications band, wherein operation of the antenna in the second communications band is unaffected when the antenna tuning circuitry switches between the first and second configurations.

15. The wireless electronic device defined in claim 14, wherein the first communications band is centered at 900 MHz, wherein the second communications band is centered at 1850 MHz, and wherein the third communications band is centered at 700 MHz.

16. The wireless electronic device defined in claim 14, wherein the antenna tuning circuitry comprises:

variable capacitor circuitry that bridges the at least one gap.

17. The wireless electronic device defined in claim 14, wherein the antenna comprises positive and negative feeds and wherein the antenna tuning circuitry comprises:

a variable inductor that bridges the positive and negative antenna feed terminals.

18. The wireless electronic device defined in claim 14, wherein the antenna further comprises an antenna feed and wherein the antenna tuning circuitry comprises tunable impedance matching circuitry, further comprising:

radio transceiver circuitry, wherein the tunable impedance matching circuitry is interposed between the radio transceiver circuitry and the antenna feed.

19. The wireless electronic device defined in claim 14, wherein the antenna tuning circuitry bridges the at least one gap.

20. The wireless electronic device defined in claim 14, wherein the antenna tuning circuitry comprises:

variable circuitry having a first terminal coupled to the conductive structure and a second terminal coupled to a ground plane for the antenna, wherein the variable circuitry is configured to switch between the first and second configurations.

21. The wireless electronic device defined in claim 20, wherein the variable circuitry comprises an inductor coupled in series with a switch.

22. The wireless electronic device defined in claim 20, wherein the variable circuitry comprises a variable capacitor.

23. The wireless electronic device defined in claim 20, wherein the first terminal is coupled to the conductive structure at a first side of the gap and the second terminal is coupled to the ground plane at a second side of the gap that opposes the first side of the gap.

24. The wireless electronic device defined in claim 23, wherein the wireless electronic device has a length, a width that is shorter than the length, and a height that is shorter than the width, the conductive structure extends across the height of the handheld electronic device, and the gap extends across the height of the electronic device from a top surface of the housing to a bottom surface of the housing.

* * * * *